US007415350B2

(12) United States Patent
Nishikiori

(10) Patent No.: US 7,415,350 B2
(45) Date of Patent: Aug. 19, 2008

(54) STOPPING POSITION CONTROL APPARATUS AND METHOD FOR INTERNAL COMBUSTION ENGINE

(75) Inventor: Takashi Nishikiori, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/905,462

(22) Filed: Oct. 1, 2007

(65) Prior Publication Data

US 2008/0083390 A1 Apr. 10, 2008

(30) Foreign Application Priority Data

Oct. 4, 2006 (JP) ..... 2006-273087

(51) Int. Cl.
*F02D 45/00* (2006.01)

(52) U.S. Cl. ..... 701/112

(58) Field of Classification Search ..... 701/112, 701/113, 115, 102; 123/179.4
See application file for complete search history.

(56) References Cited

U.S. PATENT DOCUMENTS 4,423,307 A * 12/1983 Kondo et al. ..... 123/142.5 E
6,093,974 A * 7/2000 Tabata et al. ..... 180/65.2
2008/0115760 A1* 5/2008 Nakamura et al. ..... 123/493

FOREIGN PATENT DOCUMENTS

JP A-08-061110 3/1996
JP A-2004-293444 10/2004

* cited by examiner

*Primary Examiner*—Hieu T Vo
(74) *Attorney, Agent, or Firm*—Oliff & Berridge, PLC

(57) ABSTRACT

A stopping position control apparatus and method for an internal combustion engine, over which an automatic stop/restart control is executed, is suggested. With the stopping position control apparatus and method, the crankshaft stopping position control is executed accurately by minimizing the influence of the loads placed on the internal combustion engine by auxiliary devices. The position at which the crankshaft stops when the internal combustion engine is automatically stopped is controlled by controlling the engine speed at which ignition is stopped. When issuance of a command to automatically stop the internal combustion engine is predicted, the auxiliary devices of the internal combustion engine are stopped before the internal combustion engine is automatically stopped.

24 Claims, 10 Drawing Sheets

STOPPING POSITION CONTROL APPARATUS AND METHOD FOR INTERNAL COMBUSTION ENGINE

INCORPORATION BY REFERENCE

The disclosure of Japanese Patent Application No. 2006-273087 filed on Oct. 4, 2006, including the specification, drawings and abstract is incorporated herein by reference in its entirety.

BACKGROUND OF THE INVENTION

1. Field of the Invention

The invention relates generally to a stopping position control apparatus and method for an internal combustion engine. More specifically, the invention relates to a stopping position control apparatus and method that appropriately controls an internal combustion engine over which an automatic stop/restart control (eco-run control) is executed when a vehicle temporarily stops.

2. Description of the Related Art

For example, Japanese Patent Application Publication No. 2004-293444 (JP-A-2004-293444) describes an engine starting system which executes a control (eco-run control) for automatically stopping and then restarting an internal combustion engine when a vehicle is temporarily stopped. This system adjusts the engine speed at which fuel supply is stopped, in order to stop a piston at a more appropriate position (i.e., in order to stop a crankshaft shaft at a more appropriate crankshaft position) when the internal combustion engine is automatically stopped. With this control, the internal combustion engine is restarted more smoothly. Also, this system removes external loads (i.e., loads placed on the internal combustion engine by the auxiliary devices) when a condition for automatically stopping the internal combustion engine is satisfied. Japanese Patent Application Publication No. 8-61110 (JP-A-8-61110) also describes a similar technology.

The system described above removes the loads placed on the internal combustion engine by the auxiliary devices after a command to automatically stop the internal combustion engine is issued. With such a configuration, the internal combustion engine may be automatically stopped before the loads placed on the internal combustion engine by the auxiliary devices are completely removed (i.e., when some loads are still placed on the internal combustion engine by the auxiliary devices). In such a case, the crankshaft stop position may vary depending on the amount of loads that are still placed on the internal combustion engine when it is automatically stopped.

SUMMARY OF THE INVENTION

The invention provides a stopping position control apparatus and method for an internal combustion engine, with which the influence of loads placed on the internal combustion engine by auxiliary devices is minimized, and therefore a crankshaft stopping position control is executed accurately.

A first aspect of the invention relates to a stopping position control apparatus for an internal combustion engine, including: a stop command determination unit that determines whether a command to automatically stop the internal combustion engine has been issued; an automatic stop execution unit that stops combustion in the internal combustion engine, when an engine speed matches a combustion stop speed after it is determined that the command to automatically stop the internal combustion engine has been issued, a stop command prediction unit that predicts whether the command to automatically stop the internal combustion engine is issued; and an auxiliary device stop unit that stops an auxiliary device of the internal combustion engine before the command to automatically stop the internal combustion engine is issued, when issuance of the command to automatically stop the internal combustion engine is predicted.

Accordingly, when it is predicted that the internal combustion engine will soon be automatically stopped, the auxiliary device is stopped before an automatic stop command is issued. Therefore, when the internal combustion engine is automatically stopped, the load is no longer placed on the internal combustion engine by the auxiliary device. That is, it is possible to create the state in which the load from the auxiliary device does not exert the influence on the internal combustion engine, more specifically, the state in which production of the load by the auxiliary device is finished substantially completely, when the internal combustion engine is automatically stopped. As a result, it is possible to reliably avoid the situation in which the crankshaft stopping position varies under the influence of the load from the auxiliary device.

A second aspect of the invention relates to a stopping position control apparatus for an internal combustion engine, including: a stop command determination unit that determines whether a command to automatically stop the internal combustion engine has been issued; an automatic stop execution unit that stops combustion in the internal combustion engine, when an engine speed matches a combustion stop speed after it is determined that the command to automatically stop the internal combustion engine has been issued; a friction model used to calculate friction applied to a crankshaft of the internal combustion engine; a friction learning unit that learns the friction model based on information concerning a crank angle in the internal combustion engine; a crankshaft position estimation unit that obtains an estimated value of a crankshaft stopping position based on predetermined parameters including the friction and atmospheric pressure; a stop command prediction unit that predicts whether the command to automatically stop the internal combustion engine is issued; and an auxiliary device stop unit that stops an auxiliary device of the internal combustion engine before the command to automatically stop the internal combustion engine is issued, when issuance of the command to automatically stop the internal combustion engine is predicted.

Accordingly, when it is predicted that the internal combustion engine will soon be automatically stopped, the auxiliary device is stopped before an automatic stop command is issued. Therefore, when the internal combustion engine is automatically stopped, the load is no longer placed on the internal combustion engine by the auxiliary device. As a result, it is possible to reliably avoid the situation in which the crankshaft stopping position varies under the influence of the load from the auxiliary device. In addition, it is possible to reliably avoid the situation in which the accuracy of the friction learning is reduced under the influence of the load from the auxiliary device.

A third aspect of the invention relates to a stopping position control apparatus for an internal combustion engine, including: a stop command determination unit that determines whether a command to automatically stop the internal combustion engine has been issued; an automatic stop execution unit that stops combustion in the internal combustion engine, when an engine speed matches a combustion stop speed after it is determined that the command to automatically stop the internal combustion engine has been issued; a stop command prediction unit that predicts whether the command to automatically stop the internal combustion engine is issued; and an auxiliary device stop unit that stops an auxiliary device of the internal combustion engine at a timing that is set such that a load placed on the internal combustion engine by the auxiliary device is completely removed before the command to automatically stop the internal combustion engine is issued, when issuance of the command to automatically stop the internal combustion engine is predicted.

Accordingly, when it is predicted that the internal combustion engine will soon be automatically stopped, an auxiliary device of the internal combustion engine is stopped at a timing that is set such that a load placed on the internal combustion engine by the auxiliary device is completely removed before the command to automatically stop the internal combustion engine is issued. Therefore, when the internal combustion engine is automatically stopped, the load is no longer placed on the internal combustion engine by the auxiliary device. As a result, it is possible to reliably avoid the situation in which the crankshaft stopping position varies under the influence of the load from the auxiliary device. In addition, it is possible to reliably avoid the situation in which the accuracy of the friction leaning is reduced under the influence of the load from the auxiliary device.

A fourth aspect of the invention relates to a stopping position control apparatus for an internal combustion engine, including: a stop command determination unit that determines whether a command to automatically stop the internal combustion engine has been issued; an automatic stop execution unit that stops combustion in the internal combustion engine, when an engine speed matches a combustion stop speed after it is determined that the command to automatically stop the internal combustion engine has been issued; a friction model used to calculate friction applied to a crankshaft of the internal combustion engine; a friction learning unit that learns the friction model based on information concerning a crank angle in the internal combustion engine; a crankshaft position estimation unit that obtains an estimated value of a crankshaft stopping position based on predetermined parameters including the friction and atmospheric pressure; a stop command prediction unit that predicts whether the command to automatically stop the internal combustion engine is issued; and an auxiliary device stop unit that stops an auxiliary device of the internal combustion engine at a timing that is set such that a load placed on the internal combustion engine by the auxiliary device is completely removed before the command to automatically stop the internal combustion engine is issued, when issuance of the command to automatically stop the internal combustion engine is predicted.

Accordingly, when it is predicted that the internal combustion engine will soon be automatically stopped, an auxiliary device of the internal combustion engine is stopped at a timing that is set such that a load placed on the internal combustion engine by the auxiliary device is completely removed before the command to automatically stop the internal combustion engine is issued. Therefore, when the internal combustion engine is automatically stopped, the load is no longer placed on the internal combustion engine by the auxiliary device. As a result, it is possible to reliably avoid the situation in which the crankshaft stopping position varies under the influence of the load from the auxiliary device. In addition, it is possible to reliably avoid the situation in which the accuracy of the friction learning is reduced under the influence of the load from the auxiliary device.

The stopping position control apparatus according to any one of the first to fourth aspects of the invention may further include an auxiliary device restarting unit that restart the auxiliary device when the command to automatically stop the internal combustion engine is not issued within a predetermined time period after the auxiliary device is stopped based on the prediction.

Thus, it is possible to prevent the auxiliary device from being stopped for an excessively long time. Therefore, it is possible to avoid the situation where the auxiliary devices are not able to exhibit their performance when required because priority is given to accurately controlling the crankshaft stopping position.

The stopping position control apparatus according to any one of the first to fourth aspects of the invention may further include an automatic stop prohibition unit that prohibits the internal combustion engine from being automatically stopped, when a hazard light of a vehicle is on.

Thus, it is possible to satisfy a demand to quickly accelerate the vehicle again or a demand to smoothly move the vehicle operation during parking.

The stopping position control apparatus according to any one of the first to fourth aspects of the invention may further include an auxiliary device stop prohibition unit that prohibits the auxiliary device from being stopped based on the prediction, when a hazard light of a vehicle is on.

Thus, the auxiliary devices are prevented from being stopped unnecessarily, when it is recognized that automatically stopping the internal combustion engine is inappropriate because the hazard lights are flashing, for example, in the event of an emergency.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE EMBODIMENTS

First Embodiment of the Invention

Figure 1:
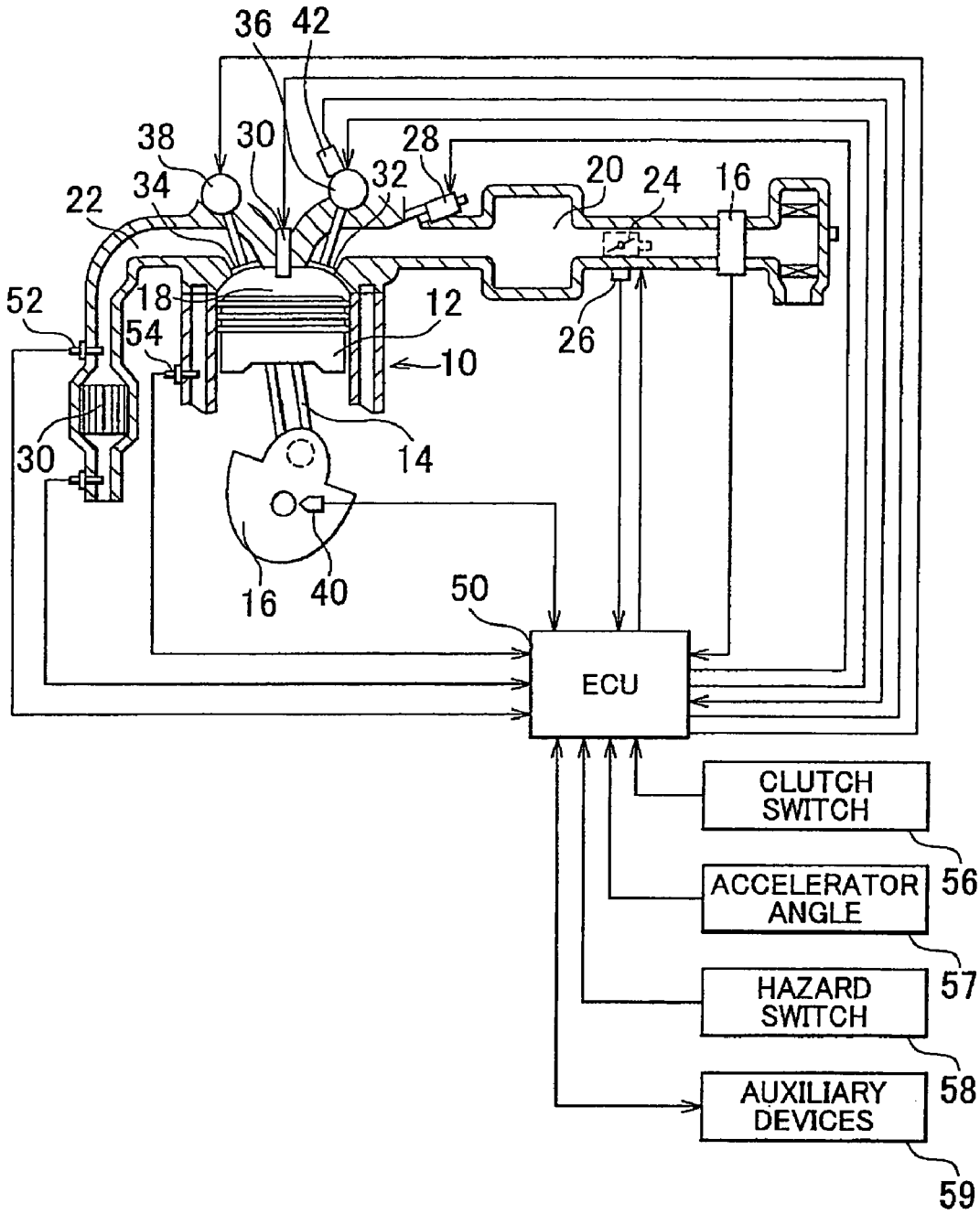
FIG. 1 is a view showing the structure of an internal combustion engine provided with a stopping position control apparatus for an internal combustion engine according to embodiments of the invention.

FIG. 1 is a view showing the structure of an internal combustion engine 10 provided with a stopping position control apparatus for an internal combustion engine according to a first embodiment of the invention. A system according to the embodiment of the invention includes the internal combustion engine 10. The internal combustion engine 10 is an in-line four-cylinder engine, in the first embodiment of the invention. A piston 12 is arranged in each cylinder formed within the internal combustion engine 10. The piston 12 is connected to a crankshaft 16 via a connecting rod 14. Also, a combustion chamber 18 is formed above the top portion of the piston 12 in each cylinder of the internal combustion engine 10. This combustion chamber 18 is communicated with an intake passage 20 and an exhaust passage 22.

A throttle valve 24 is provided in the intake passage 20. The throttle valve 24 is an electronically-controlled throttle valve that controls the throttle opening amount independently from the accelerator position. A throttle position sensor 26 that detects the throttle opening amount TA is disposed near the throttle valve 24. A fuel injection valve 28 that injects fuel into an intake port of the internal combustion engine 10 is provided downstream of the throttle valve 24. Also, a spark plug 30 is fitted to a cylinder head of the internal combustion engine so as to protrude from the top portion of the combustion chamber 18 into the combustion chamber 18 in each cylinder. An intake valve 32 which selectively allows or interrupts communication between the combustion chamber 18 and the intake passage 20 is provided at the intake port. Similarly, an exhaust valve 34 which selectively allows or interrupts communication between the combustion chamber 18 and the exhaust passage 22 is provided at an exhaust port.

The intake valve 32 is driven by an intake variable valve timing (VVT) mechanism 36, and the exhaust valve 34 is driven by an exhaust variable valve timing (VVT) mechanism 38. The intake VVT mechanism 36 opens and closes the intake valve 32 in sync with the rotation of the crankshaft 16, and is able to change the opening characteristics (e.g., opening timing, duration, lift amount, etc.) of the intake valve 32. Similarly, the intake VVT mechanism 38 opens and closes the exhaust valve 34 in sync with the rotation of the crankshaft 16, and is able to change the opening characteristics of the exhaust valve 34.

The internal combustion engine 10 is provided with a crank angle sensor 40 near the crankshaft 16. The a crank angle sensor 40 alternately outputs a high-level signal (Hi) and a low-level signal (Lo) each time the crankshaft 16 rotates a predetermined angle. The rotational position and rotational speed (i.e., the engine speed Ne) of the crankshaft 16 are detected according to signals from the crank angle sensor 40. The internal combustion engine 10 is also provided with a cam angle sensor 42 near an intake camshaft. This cam angle sensor 42 has the same structure as that of the crank angle sensor 40. The rotational position (i.e., the advance amount), etc. of the intake camshaft are detected according to signals from the cam angle sensor 42.

The system shown in FIG. 1 includes an ECU (Electronic Control Unit) 50. In addition to the sensors described above, various other sensors are also connected to the ECU 50. Examples of the various sensors are an air-fuel ratio sensor 52 that detects the air-fuel ratio of the exhaust gas in the exhaust passage 22, a coolant temperature sensor 54 that detects the temperature of coolant in the internal combustion engine 10, a clutch switch 56 that detects the engagement state of a clutch, not shown, provided between the internal combustion engine 10 and a transmission, also not shown, an accelerator position sensor 57 that detects the position of an accelerator pedal, and a hazard switch 58. The clutch switch 56 produces an ON signal (indicating that the clutch is disengaged) when a clutch pedal, not shown, is depressed, and produces an OFF signal (indicating that the clutch is engaged) when the clutch pedal is not depressed. Also, various auxiliary devices 59 of the internal combustion engine 10 are also connected to the ECU 50. Examples of the auxiliary devices 59 are an alternator, a power steering pump, an air-conditioner compressor, an oil pump, and a water pump. These auxiliary devices 59 are controlled to run and stop based on commands from the ECU 50. In addition, various actuators are also connected to the ECU 50. The ECU 50 controls the operating state of the internal combustion engine 10 based on the signals from the various sensors described above, as well as results of calculation executed using a virtual engine model 60 formed within the ECU 50.

[Outline of Engine Model]

Figure 2:
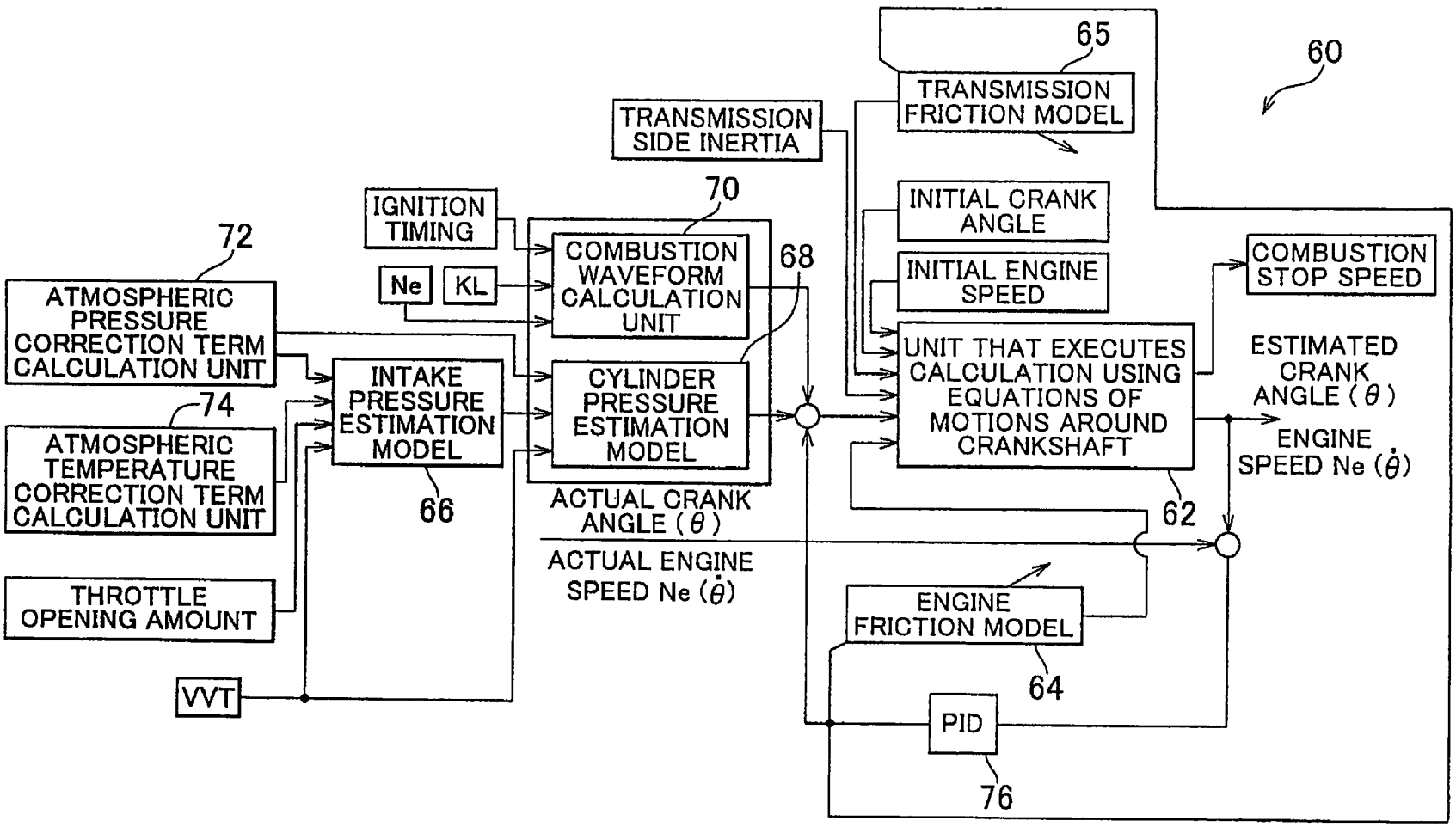
FIG. 2 is a block diagram showing the structure of an engine model provided in an ECU shown in FIG. 1.

FIG. 2 is a block diagram showing the configuration of the engine model 60 formed within the ECU 50 shown in FIG. 1. As shown in FIG. 2, the engine model 60 includes a unit 62 that executes calculation using equations of motions around the crankshaft (hereinafter, simply referred to as a "motion equation-based calculation unit 62"), an engine friction model 64, a transmission friction model 65, an intake pressure estimation model 66, a cylinder pressure estimation model 68, a combustion waveform calculation unit 70, an atmospheric pressure correction term calculation unit 72, and an atmospheric temperature correction term calculation unit 74. Hereinafter, the configurations of these units will be described in detail.

(1) Unit that Executes Calculation Using Equations of Motions Around the Crankshaft (Motion Equation-Based Calculation Unit)

The motion equation-based calculation unit 62 calculates an estimated value of a crank angle θ and an estimated value of an engine speed Ne (i.e., crank angle rotational speed dθ/dt). The motion equation-based calculation unit 62 receives a signal indicating a cylinder pressure P in the internal combustion engine 10 from the cylinder pressure estimation model 68 or the combustion waveform calculation unit 70. When the calculation begins, the motion equation-based calculation unit 62 also receives a signal indicating an initial crank angle $\theta_0$ and a signal indicating an initial engine speed $Ne_0$.

The estimated crank angle θ and the estimated engine speed Ne calculated by the motion equation-based calculation unit 62 are controlled in a feedback manner by a PID controller 76 shown in FIG. 2 such that the deviation of estimated crank angle θ from the actual crank angle θ and the deviation of the estimated engine speed Ne from the actual engine speed Ne are eliminated. Also, the engine friction model 64 reflects the influence of friction in the internal combustion engine 10 on the calculation results obtained by the motion equation-based calculation unit 62. Similarly, the transmission friction model 65 reflects the influence of friction in the transmission (mainly, the friction caused by the rotational sliding motion of a shaft with respect to a bearing) on the calculation results obtained by the motion equation based calculation unit 62.

Figure 3:
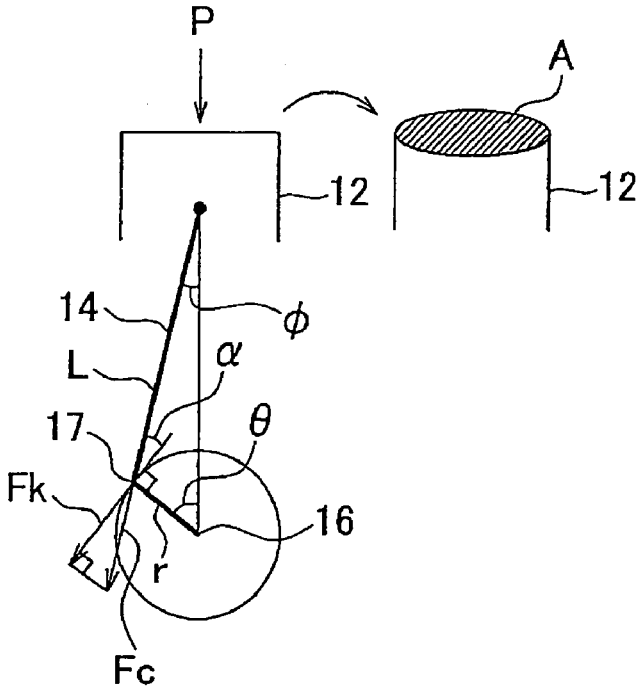
FIG. 3 is a view showing reference characters of various elements around a crankshaft.

Next, the calculations executed in the motion equation-based calculation unit 62 will be described in detail. FIG. 3 is a diagram showing reference characters assigned to the elements around the crankshaft. As shown in FIG. 3, reference character A denotes the surface area of the top portion of the piston 12 that receives the cylinder pressure P. Reference character L denotes the length of the connecting rod 14, and reference character r denotes the radius of rotation of the crankshaft. Reference character ϕ (hereinafter, referred to as the "connecting rod angle ϕ") denotes the angle formed between the virtual line (the axis of the cylinder) that connects the point at which the piston is connected to the connecting rod 14 with the axis of the crankshaft 16, and the axis of the connecting rod 14. Reference character θ denotes the angle formed between the axis of the cylinder and the axis of a crankpin 17.

In the internal combustion engine 10 which has four cylinders, the phase difference in the crank angle among the cylinders is 180° CA. Therefore, the relationship among the crank angles of the cylinders is expressed by Equation 1a below. Also, the crank angle rotational speed dθ/dt of each cylinder is obtained by temporally differentiating the crank angle θ of each cylinder, and therefore expressed by Equation 1b below.

[Equation 1]

$$\theta_1 = \theta,\ \theta_2 = \theta + \pi,\ \theta_3 = \theta + 2\pi,\ \theta_4 = \theta + 3\pi \quad \text{1a}$$

$$\dot{\theta} = \dot{\theta}_1,\ \dot{\theta} = \dot{\theta}_2,\ \dot{\theta} = \dot{\theta}_3,\ \dot{\theta} = \dot{\theta}_4 \quad \text{1b}$$

$$\left(\dot{\theta} = \frac{d\theta}{dt}\right)$$

In Equations 1a and 1b above, reference numerals 1 to 4 appended to the crank angle θ and the crank angle rotational speed dθ/dt correspond to the order of the cylinders in which combustion takes place according to a predetermined firing order of the internal combustion engine 10. Also, in the equations which will be described below, these reference numerals 1 to 4 may be represented by the reference character "i".

Further, in a piston/crank mechanism shown in FIG. 3, the relationship between the crank angle θi and the connecting rod angle ϕi is expressed by Equation 2 below.

[Equation 2]

$$\sin(\Phi_i) = \frac{r}{L}\sin(\theta_i),\ \cos(\Phi_i) = \sqrt{1 - \left(\frac{r}{L}\right)\sin^2(\theta_i)}\ , \quad \text{2}$$

$$\dot{X}_i = r \cdot \sin(\theta_i)\left\{1 + \frac{\frac{r}{L}\cos(\theta_i)}{\sqrt{1 - \left(\frac{r}{L}\right)^2 \sin^2(\theta_i)}}\right\}\dot{\theta}_i$$

$$(\dot{X}i = dXi/dt)$$

where dXi/dt is the piston speed.

Also, the total kinetic energy T around the crankshaft is expressed by Equation 3 below. When Equation 3 is expanded, all of the parameters of the terms in Equation 3 are expressed by the coefficient of ½(dθ/dt)$^2$. Here, the thus coefficient is expressed as the function f(θ) of the crank angle θ.

[Equation 3]

$$\begin{aligned} T &= \frac{1}{2}(I_k + I_{fl} + I_{mi})\dot{\theta}^2 + \sum_{i=1}^{4}\frac{1}{2}(m_p + m_c)\dot{X}_i^2 + \sum_{i=1}^{4}\frac{1}{2}I_c\dot{\Phi}_i^2 \\ &= \frac{1}{2}\left[(I_k + I_{fl} + I_{mi}) + (m_p + m_c)r^2 \cdot \sum_{i=1}^{4}\sin^2(\theta_i) \cdot \left\{1 + \frac{\frac{r}{L}\cos(\theta_i)}{\sqrt{1 - \left(\frac{r}{L}\right)^2\sin^2(\theta_l)}}\right\}^2 + I_c\left(\frac{r}{L}\right)^2 \cdot \sum_{i=1}^{4}\frac{\cos^2(\theta_i)}{1 - \left(\frac{r}{L}\right)^2\sin^2(\theta_i)}\right] \cdot \dot{\theta}^2 \\ &= \frac{1}{2} \cdot f(\theta) \cdot \dot{\theta}^2 \end{aligned} \quad \text{3}$$

In this Equation 3, the first term in the right side corresponds to the kinetic energy related to the rotary motion of the crankshaft 16, the second term in the right side corresponds to the kinetic energy related to the translatory motions of the piston 12 and the connecting rod 14, and the third term in the right side corresponds to the kinetic energy related to rotary motion of the connecting rod 14. Also, in Equation 3 above, $I_k$ is the inertia moment around the axis of the crankshaft 16, $I_{fl}$ is the inertia moment around the rotational axis of a flywheel, $I_{mi}$ is the inertia moment around the rotational axis of the transmission which is used in combination with the internal combustion engine 10, and $I_c$ is the inertia moment related to the connecting rod. Also, $m_p$ is the displacement of the piston 12, and $m_c$ is the displacement of the connecting rod 14. The inertia moment related to the transmission (i.e., the inertia on the transmission side) is used only in the calculation executed using the model when it is determined that the clutch is engaged. The inertial moment related to the transmission is zero in the calculation executed using the model when it is determined that the clutch is disengaged.

Next, the Lagrangian L is defined as the difference between the total kinetic energy T in the system and the potential energy U. The Lagrangian L is expressed by Equation 4a below. When the input torque applied to the crankshaft 16 is TRQ, the relationship among the Lagrangian L, the crank angle θ, and the input torque TRQ is expressed by Equation 4b below using the Lagrange equation of motion.

[Equation 4]

$$L = T - U \quad \text{4a}$$

$$\frac{d}{dt}\frac{\partial L}{\partial \dot{\theta}} - \frac{\partial L}{\partial \theta} = TRQ \quad \text{4b}$$

$$\frac{\partial L}{\partial \dot{\theta}} = f(\theta)\dot{\theta},\ \frac{d}{dt}\frac{\partial L}{\partial \dot{\theta}} = \frac{d}{dt}\frac{\partial f(\theta)}{\partial \theta}\dot{\theta}^2 + f(\theta)\ddot{\theta} \quad \text{4c}$$

$$\frac{\partial L}{\partial \theta} = \frac{1}{2}\frac{\partial f(\theta)}{\partial \theta}\dot{\theta}^2 \quad \text{4d}$$

$$\therefore \frac{d}{dt}\frac{\partial L}{\partial \dot{\theta}} - \frac{\partial L}{\partial \theta} = TRQ \Leftrightarrow f(\theta)\ddot{\theta} + \frac{1}{2}\frac{\partial f(\theta)}{\partial \theta}\dot{\theta}^2 = TRQ \quad \text{4e}$$

In Equation 4a, the influence of the potential energy U is less than the influence of the kinetic energy T, and therefore can be ignored. Accordingly, the first term in the left side of Equation 4b is expressed by Equation 4c as the function of the crank angle θ by temporally differentiating the value obtained by partially differentiating Equation 3 above with respect to the crank angle rotational speed (dθ/dt). Also, the second term in the left side of Equation 4b is expressed by Equation 4d as the function of the crank angle θ by partially differentiating Equation 3 above with respect to the crank angle θ.

Accordingly, Equation 4b above is expressed by Equation 4e. As a result, the relationship between the crank angle θ and the input torque TRQ is obtained. In this case, the input torque TRQ is defined by three parameters, as shown in Equation 5 below.

[Equation 5]

$$TRQ=TRQ_e-TRQ_L-TRQ_f$$

In Equation 5, $TRQ_e$ is the torque produced by the engine, more specifically, the torque applied to the crankshaft 16 from the piston 12 that receives the gas pressure (i.e., the cylinder pressure P). $TRQ_L$ is the load torque and is stored in the ECU 50 as a known value that varies depending on the characteristics of the vehicle in which the internal combustion engine 10 is mounted. $TRQ_f$ is the friction torque, i.e., the torque corresponding to the friction loss caused at the piston 12, the crankshaft 16, and the sliding portions of the transmission. This friction torque $TRQ_f$ is a value that is calculated using the engine friction model 64 and the transmission friction model 65. More specifically, when the clutch is engaged, the friction torque $TRQ_f$ is calculated using both the engine friction model 64 and the transmission friction model 65. On the other hand, when the clutch is disengaged, the friction torque $TRQ_f$ is calculated using only the engine friction model 64.

The engine production torque $TRQ_e$ is calculated according to Equations 6a to 6c below. The force $F_c$ applied to the connecting rod 14 based on the cylinder pressure P is expressed by Equation 6a as a component of the force PA acting on the top portion of the piston 12, the component being applied in the axial direction of the connecting rod 14. As shown in FIG. 3, the angle α formed between the axis of the connecting rod 14 and the tangent of the trajectory of the crankpin 17 is [π/2−(ϕ+θ)]. Accordingly, the force $F_k$ acting in the direction, in which the tangent of the trajectory of the crankpin 17 extends, based on the cylinder pressure P is expressed by Equation 6b using the force $F_c$ acting on the connecting rod 14. Therefore, the engine production torque $TRQ_e$ is the product of the force $F_k$ acting in the direction, in which the tangent of the trajectory of the crankpin 17 extends, and the rotation radius r of the crankshaft. Accordingly, the engine production torque $TRQ_e$ is expressed by Equation 6c using Equation 6a and Equation 6b.

[Equation 6]

$$F_c = P\cdot A\cos(\Phi) \quad 6a$$

$$F_k = F_c\sin(\Phi+\theta) \quad 6b$$

$$\therefore TRQ_e = F_k\cdot r = P\cdot A\cdot r\cdot\cos(\Phi)\sin(\Phi+\theta)$$

$$= P\cdot A\cdot r\cdot\left[\left\{1-\left(\frac{r}{L}\right)^2\sin^2(\theta)\right\}+\frac{r}{L}\cos(\theta)\right]\sin(\theta) \quad 6c$$

With the configuration of the motion equation-based calculation unit 62 described above, when the cylinder pressure P is obtained using the cylinder pressure estimation model 68 or the combustion waveform calculation unit 70, the input torque TRQ is obtained according to Equation 6c and Equation 5. Also, the crank angle θ and the crank angle rotational speed dθ/dt are obtained by solving Equation 4e.

(2) Engine Friction Model

Figure 4A:
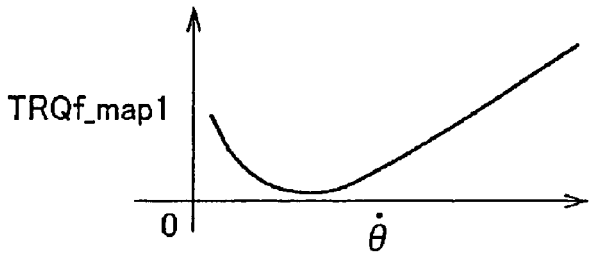
FIGS. 4A and 4B show examples of engine friction maps which are used to obtain the engine friction torque and which are provided in an engine friction model shown in FIG. 2.
Figure 4B:
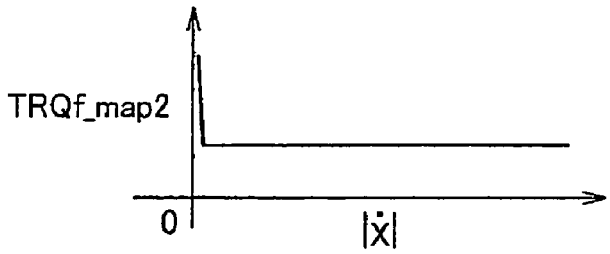

FIGS. 4A and 4B show examples of engine friction maps which are used to obtain the engine friction torque $TRQ_{f_EN}$. The engine friction model 64 shown in FIG. 2 has these engine friction maps. More specifically, FIG. 4A is a graph conceptually showing the relationship between the crank angle rotational speed (dθ/dt) and a first engine friction torque $TRQ_{f_map1}$ related to the rotational sliding motion around the crankshaft 16. FIG. 4B is a graph conceptually showing the relationship between piston speed (dXi/dt) and a second engine friction torque $TRQ_{f_map2}$ related to the translational motion of the piston 12.

In the system according to the first embodiment of the invention, the engine friction torque $TRQ_{f_EN}$ may be divided into the first engine friction torque $TRQ_{f_map1}$ and the second engine friction torque $TRQ_{f_map2}$, as described above. Then, the first engine friction torque $TRQ_{f_map1}$ and the second engine friction torque $TRQ_{f_map2}$ are used in the routine, which will be described later with reference to FIG. 7. In this way, the accuracy of calculation executed using the engine model 60 is improved.

As shown in FIG. 4A, the first engine friction torque $TRQ_{f_map1}$ related to the rotational sliding motion around the crankshaft 16 basically depends on the engine speed (dθ/dt). More specifically, as shown in FIG. 4A, in the region where the engine speed (dθ/dt) is close to zero, the first engine friction torque $TRQ_{f_map1}$ is high under the influence of the maximum static friction coefficient. When the engine speed (dθ/dt) starts to increase, the influence of the maximum static friction coefficient is reduced and therefore the first engine friction torque $TRQ_{f_map1}$ temporarily decreases. After that, the first engine friction torque $TRQ_{f_map1}$ increases as the engine speed (dθ/dt) increases.

Also, as shown in FIG. 4B, the second engine friction torque $TRQ_{f_map2}$ related to the translational motion of the piston 12 is a friction between the piston 12 and the cylinder wall face. The second engine friction torque $TRQ_{f_map2}$ depends only on the friction coefficient and the contact pressure between the piston 12 and the cylinder wall face, and does not depend on the piston speed (dXi/dt). The second engine friction torque $TRQ_{f_map2}$ exhibits a considerably high value in the region where the piston speed (dXi/dt) is close to zero in FIG. 4B. This is because the influence of the maximum static friction coefficient is great in this region.

The engine friction torque $TRQ_{f_EN}$ tends to increase as the engine coolant temperature decreases. Therefore, although not shown in FIG. 4, the engine friction torque $TRQ_{f_EN}$ is set with the relationship with the engine coolant temperature as well as the relationship with the engine speed Ne (and the piston speed (dXi/dt)) taken into account. In order to reduce the calculation load placed on the ECU 50, the engine friction model 64 has the above-described friction maps. However, the configuration of the engine friction model is not limited to this. For example, Equation 7 below may also be used. In Equation 7, the friction torque $TRQ_{f_EN}$ is a function that uses the engine speed Ne and the kinetic viscosity ν of the lubrication oil for the internal combustion engine 10 as parameters.

[Equation 7]

$$TRQ_{f_EN}=C_1 \cdot Ne^2+C_2 \cdot v+C_3 \quad 7$$

, wherein $C_1$, $C_2$, and $C_3$ are coefficients, for example, empirically derived.

(3) Transmission Friction Model

Figure 5:
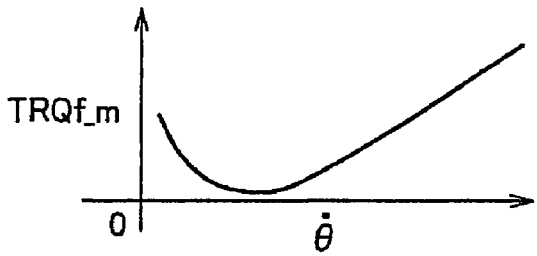
FIG. 5 is an example of a transmission friction map which is used to obtain the transmission friction torque and which is provided in a transmission friction model shown in FIG. 2.

FIG. 5 is an example of a transmission friction map used to obtain the transmission friction torque $TRQ_{f_MI}$. The transmission friction model 65 shown in FIG. 2 has the transmission friction map. The transmission friction torque $TRQ_{f_MI}$ calculated using the transmission friction model 65 is the friction torque obtained when the transmission is in Neutral and the clutch is engaged while the vehicle is stopped, i.e., when the gears of the transmission are rotating without transmitting power from the internal combustion engine 10 to the tires. Therefore, the transmission friction torque $TRQ_{f_MI}$ is set to correspond to the friction in the transmission (mainly, the friction caused by the rotational sliding motion of a shaft with respect to a bearing). Therefore, as shown in FIG. 5, the transmission friction torque $TRQ_{f_MI}$ depends on the engine speed (dθ/dt), just like the first engine friction torque $TRQ_{f_map1}$.

(4) Intake Pressure Estimation Model

The intake pressure estimation model 66 has an intake pressure map, not shown, used to estimate the intake pressure. The intake air map defines the relationship between the intake air pressure, and the throttle opening amount TA, the engine speed Ne, and the valve timing VVT of the intake and exhaust valves. Configuring the intake pressure estimation model in this way makes it possible to obtain the intake pressure while minimizing the calculation load placed on the ECU 50. When the intake pressure needs to be calculated to high degrees of detail, the intake pressure estimation model may be configured using a throttle model that is used to estimate the flow-rate of the air passing through the throttle valve 24 and a valve model that is used to estimate the flow-rate of the air passing through the area near intake valve 32 (i.e., the flow-rate of the air drawn into the cylinder), instead of using the intake pressure map described above.

(5) Cylinder Pressure Estimation Model

The cylinder pressure estimation model 68 is used to calculate the cylinder pressure P when combustion does not take place. With this cylinder pressure estimation model 68, the cylinder pressures P during the four strokes of the internal combustion engine 10 are calculated using Equations 8a to 8d below. As shown in Equation 8a, the cylinder pressure P during the intake stroke is obtained based on a map value $P_{map}$ of the cylinder pressure, which is obtained based on the intake pressure map in the intake pressure estimation model 66 described above.

[Equation 8]

Intake Stroke $$P = P_{map}(Ne, VVT, TA) \quad 8a$$

Compression Stroke $$P = \left(\frac{V_{bdc}}{V}\right)^{\kappa} \cdot P_{map} \quad 8b$$

Power Stroke $$P = \left(\frac{V_{tdc}}{V}\right)^{\kappa} \cdot P_C \quad 8c$$

Exhaust Stroke $$P = P_{ex} \approx P_{air} \quad 8d$$

Based on an equation of the reversible adiabatic change in the gas, the cylinder pressure P during the compression stroke is expressed by Equation 8b. Note that, in Equation 8b, $V_{BDC}$ is the cylinder volume V when the piston 12 is at the intake BDC (bottom dead center), and κ is the specific heat ratio.

The cylinder pressure P during the power stroke is expressed by Equation 8c which is similar to Equation 8b by which the cylinder pressure P during the compression stroke is expressed. Note that, in Equation 8c, $V_{TDC}$ is the cylinder volume V when the piston 12 is at the compression TDC (top dead center), and $P_c$ is the cylinder pressure at the end of the compression stroke.

The cylinder pressure P during the exhaust stroke is equal to the pressure $P_{ex}$ in the exhaust passage 22, as indicated by Equation 8d. This pressure $P_{ex}$ can be regarded as being substantially equal to the atmospheric pressure $P_{air}$. Therefore, in this case, the atmospheric pressure $P_{air}$ is used as the cylinder pressure P during the exhaust stroke.

(6) Combustion Waveform Calculation Unit

The combustion waveform calculation unit 70 is a model used to calculate the cylinder pressure (combustion pressure) P during the period in which combustion takes place. This period is from the middle of the compression stroke until the middle of the power stroke. In the combustion waveform calculation unit 70, an estimated value of the combustion pressure P is calculated using Equation 9a which uses Weibe function, and Equation 10 which will be described later.

[Equation 9]

$$\frac{dQ}{d\theta} = a \cdot \frac{k \cdot Q}{\theta_p} \cdot (m+1) \cdot \left(\frac{\theta-\theta_b}{\theta_p}\right)^m \cdot \exp\left\{-a \cdot \left(\frac{\theta-\theta_b}{\theta_p}\right)^{m+1}\right\} \quad 9a$$

here, $$\frac{dg(\theta)}{d\theta} \equiv \frac{d}{d\theta}\underbrace{\left(\exp\left\{-a \cdot \left(\frac{\theta-\theta_b}{\theta_p}\right)^{m+1}\right\}\right)}_{g(\theta)}$$

$$= -a \cdot (m+1) \cdot \left(\frac{\theta-\theta_b}{\theta_p}\right)^m \cdot \exp\left\{-a \cdot \left(\frac{\theta-\theta_b}{\theta_p}\right)^{m+1}\right\} \quad 9b$$

Equation 9a is written as, $$\frac{dQ}{d\theta} = -\frac{k \cdot Q}{\theta_p} \cdot \frac{d}{d\theta}\left(\exp\left\{-a \cdot \left(\frac{\theta-\theta_b}{\theta_p}\right)^{m+1}\right\}\right) = -\frac{k \cdot Q}{\theta_p} \cdot \frac{dg(\theta)}{d\theta} \quad 9c$$

$$\Leftrightarrow \frac{dQ}{dQ} \cdot \frac{1}{d\theta} = -\frac{k}{\theta_p} \cdot \frac{dg(\theta)}{d\theta}$$

both sides of Equation 9c are integrated with respect to θ

$$\int \frac{1}{Q} \cdot \frac{dQ}{d\theta} d\theta = -\frac{k}{\theta_p} \cdot \int \frac{dg(\theta)}{d\theta} d\theta \quad 9d$$

$$\Leftrightarrow \int \frac{1}{Q} d\theta = -\frac{k}{\theta_p} \cdot \int dg(\theta)$$

$$\Leftrightarrow \log Q + C_2 = -\frac{k}{\theta_p} \cdot g(\theta) + C_1$$

$$\log Q = -\frac{k}{\theta_p} \cdot g(\theta) + C$$

$$Q = \exp\left(C - \frac{k}{\theta_p} \cdot g(\theta)\right) = \exp\left[C - \frac{k}{\theta_p} \cdot \exp\left\{-a \cdot \left(\frac{\theta-\theta_b}{\theta_p}\right)^{m+1}\right\}\right]$$

$C = C_1 - C_2$: C, $C_1$, $C_2$ are constants of integration

The manner in which an estimated value of the combustion pressure P is calculated will be described in more detail below. First, the combustion waveform calculation unit 70 calculates the rate of heat generation dQ/dθ that corresponds to the current crank angle θ using Equation 9a. In Equation 9a, m is the profile coefficient, k is the combustion efficiency, $\theta_b$ is the ignition delay period, and a is the combustion rate (here, a fixed value of 6.9). These parameters are set in advance. Also, Q is the heating value.

The heating value Q needs to be calculated in order to calculate the rate of heat generation dQ/dθ using Equation 9a above. The beating value Q is calculated by solving Equation 9a, which is a differential equation. Therefore, in Equation 9b, the portion corresponding to Weibe function in Equation 9a is replaced with g(θ). Thus, Equation 9a is expressed by Equation 9c. Both sides of Equation 9c are integrated with respect to the crank angle θ, and then Equation 9c is expanded, whereby the heating value Q is expressed by Equation 9d. Next, the rate of heat generation dQ/dθ is calculated by substituting the heating value Q calculated according to Equation 9d into Equation 9a again.

Based on a relational equation according to the energy conservation law, the relationship between the rate of heat generation dQ/dθ and the cylinder pressure (i.e., combustion pressure) P is expressed by Equation 10. The rate of heat generation dQ/dθ calculated according to Equation 9a is substituted into Equation 10 and then Equation 10 is solved, whereby the combustion pressure P is calculated.

[Equation 10]

$$\frac{dQ}{d\theta} = \frac{1}{\kappa - 1} \cdot \left( V \cdot \frac{dP}{d\theta} + \kappa \cdot P \cdot \frac{dV}{d\theta} \right) \quad 10$$

The cylinder pressure P when combustion does not take place is calculated using the cylinder pressure estimation model 68, and the cylinder pressure P when combustion takes place is calculated using the combustion waveform calculation unit 70. With this configuration, the history of the cylinder pressure P in the internal combustion engine 10 is obtained irrespective of whether combustion takes place.

Figure 6A:
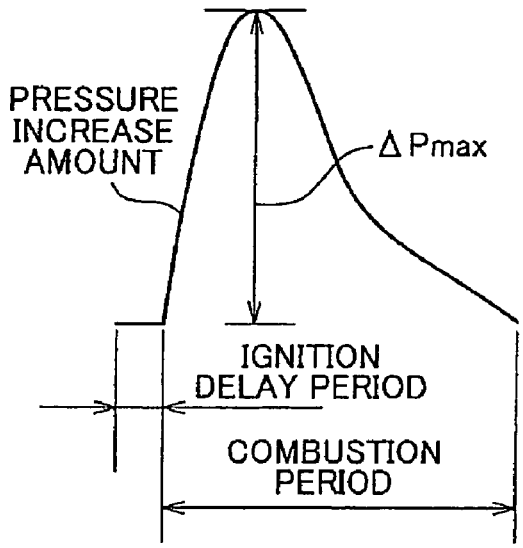
FIGS. 6A and 6B are views illustrating a method according to a modified example for obtaining the history of a cylinder pressure.
Figure 6B:
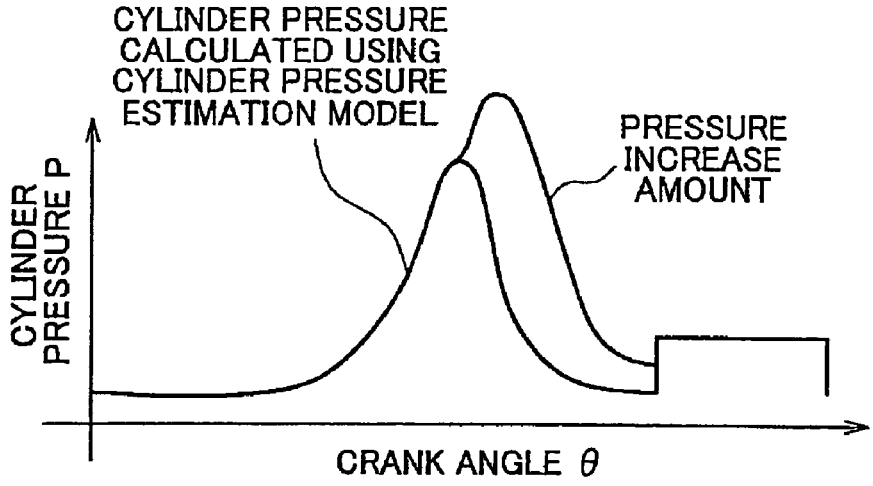

The method for obtaining the history of the cylinder pressure P in the internal combustion engine 10 is not limited to the method described above. For example, a method described below with reference to FIGS. 6A and 6B may be used. FIGS. 6A and 6B are graphs illustrating such modified method. According to this modified method, only the combustion pattern as shown in FIG. 6A, i.e., only the amount of change in the waveform of the cylinder pressure P which changes due to combustion (that is, only the amount of pressure increase due to combustion), is calculated in advance using Equations 9a and, 10, instead of calculating the combustion pressure P each time the crankshaft rotates the predetermined crank angle θ using Equations 9a and 10.

More specifically, maps are stored which define the relationships between the three parameters that determine the combustion pattern, the three parameters being the ignition delay period, combustion period, and $\Delta P_{max}$ (which is the difference between the maximum pressure $P_{max}$ when combustion takes place and the maximum pressure $P_{max0}$ when combustion does not take place), and various patterns of the engine speed Ne, the air charging efficiency KL, the valve timing VVT of the intake and exhaust valves, and the ignition timing. Then, in order to calculate the waveform corresponding to the amount of pressure increase due to combustion as an approximate waveform determined by combining simple functions such as quadratic functions, the relationship between each coefficient of the approximate waveform and the engine speed Ne is defined and indicated in a map. Then, as shown in FIG. 6B, the combustion pressure P is obtained by adding the value indicated by the waveform of the amount of pressure increase due to combustion, which is obtained using the above-described map, to the value of the cylinder pressure P calculated using the cylinder pressure estimation model 68.

(7) Atmospheric Pressure Correction Term Calculation Unit

The atmospheric pressure correction term calculation unit 72 has a model used to estimate the amount of air charged (i.e., drawn) in the cylinder (hereinafter, simply referred to as the "charged air amount") $M_c$. With this model, which we will be referred to as the "air model", the charged air amount $M_c$ is calculated according to Equation 11 below.

[Equation 11]

$$Mc = aPm - b \quad 11$$

In Equation 11, a and b are coefficients that are determined based on the operation condition (such as the engine speed Ne and the valve timing VVT). $P_m$ is the intake pressure. For example, the value calculated using the intake pressure estimation model 66 described above may be used as the intake pressure $P_m$.

Also, the atmospheric pressure correction term calculation unit 72 has a model used to estimate the amount $f_c$ of fuel drawn into the cylinder. This model will be referred to as the "fuel model". If the behavior of the fuel after it is injected from the fuel injection valve 28 is taken into account, i.e., if the phenomenon in which part of the injected fuel adheres to the inner wall, etc. of the intake port and then vaporizes is taken into account, in the case where the amount of fuel adhering to the wall face when fuel injection is started during cycle k is indicated by $f_w(k)$ and the amount of fuel that is actually injected during cycle k is indicated by $f_i(k)$, the amount of fuel adhering to the wall face $f_w(k+1)$ after cycle k ends and the amount of feel drawn into the cylinder $F_c$ during cycle k are expressed by Equations 12a and 12b, respectively.

[Equation 12]

$$f_w(k+1) = P(k) \cdot f_w(k) + R(k) \cdot f_i(k) \quad 12a$$

$$f_c(k) = (1 - P(k)); f_w(k)(1 - R(k)) \cdot f_i(k) \quad 12b$$

In Equations 12a and 12b, P is the adherence ratio, more specifically, the ratio of the amount of fuel that adheres to the inner wall, etc. of the intake port with respect to the amount of injected fuel $f_i$. R is the residual ratio, more specifically, the ratio of the amount of fuel that remains adhered to the wall face, etc. of the intake port after the intake stroke is executed with respect to the amount of fuel $f_w$ adhering to the wall face, etc. before the intake stroke is executed. According to Equations 12a and 12b, the amount of fuel $f_c$ that is drawn into the cylinder is calculated for each cycle using the adherence ratio P and the residual ratio R as parameters.

Therefore, an estimated value of the air-fuel ratio A/F is calculated using the results of calculation executed using the air model and the fuel model. The atmospheric pressure correction term calculation unit 72 next calculates the steady-state deviation of this estimated air-fuel ratio A/F from the actually measured value of the air-fuel ratio A/F that is detected at the timing, which is set with the delay between the time at which the fuel is injected and the time at which the exhaust gas reaches the air-fuel ratio sensor 52 taken into account. The steady-state deviation is the error in the charged air amount $M_c$. Accordingly, when the steady-state deviation is large, the atmospheric pressure correction term calculation unit 72 determines that the atmospheric pressure value used in the calculation deviates from the actual atmospheric pressure, and calculates an atmospheric pressure correction coefficient $k_{airp}$. More specifically, the intake pressure $P_m$ is calculated backward using the air model, and the atmospheric pressure correction coefficient $k_{airp}$, which is a correction factor for the reference atmospheric pressure $P_a$, is calculated based on the calculated intake pressure $P_m$. The atmospheric pressure correction coefficient $k_{airp}$ is used to correct the intake pressure $P_{map}$ and the exhaust pressure (i.e., atmospheric pressure $P_{air}$) in the intake pressure estimation model 66 and the cylinder pressure estimation model 68 described above.

(8) Atmospheric Temperature Correction Term Calculation Unit

The atmospheric temperature correction term calculation unit 74 calculates the cylinder pressure $P_{th}$ by substituting the actually measured values of the cylinder volume V during the exhaust stroke, the mass m of the residual gas (which is calculated based on the clearance volume $V_c$ at the exhaust TDC), the gas constant R of the residual gas (i.e., burned gas), and the atmospheric temperature $T_{air}$ into the ideal gas equation. Then, the deviation of the cylinder pressure P calculated using the cylinder pressure estimation model 68 from the cylinder pressure $P_{th}$ is calculated. If the deviation is large, a correction coefficient is calculated based on that deviation. This correction coefficient is used to correct the intake pressure $P_{map}$ in the intake pressure estimation model 66.

[Method for Calculating the Estimated Value of the Crankshaft Stopping Position]

In a vehicle provided with an internal combustion engine, the eco-run control may be performed. According to the eco-run control, the internal combustion engine is automatically stopped (idling stop) and then restarted when the vehicle is temporarily stopped. Also, in a hybrid vehicle in which an internal combustion engine and a motor are used in combination as drive power sources, a control for automatically stopping and then restarting the internal combustion engine (in this specification, this control will also be referred to as the "eco-run control" in a broad sense) may be executed while a vehicle system is operating (including while the vehicle is running).

In this eco-run control, it is desirable to accurately control the position, at which the crankshaft 16 stops (hereinafter, referred to as the "stopping position of the crankshaft 16") (i.e., the position at which the piston 12 stops) when the internal combustion engine automatically stops, to a target stopping position in order to restart the internal combustion engine smoothly. In the engine model 60 described above, the influences of friction, atmospheric pressure, atmospheric temperature, throttle opening amount, the valve timing VVT, etc. (these will be referred to as predetermined parameters in this invention) exerted on the crankshaft stopping position are appropriately modeled. Thus, in the system according to the first embodiment of the invention, the engine model 60 described above is used as a stopping position estimation model used to estimate the stopping position of the crankshaft 16 during eco-nm control. With the foregoing engine model 60, the stopping position of the crankshaft 16 when the internal combustion engine 10 is automatically stopped is obtained by obtaining an estimated value of the crank angle θ when the crank angle rotational speed dθ/dt is zero. In this specification, the stopping position of the crankshaft 16 will be sometimes referred to as the "crankshaft stopping position".

More specifically, an estimated value of the crankshaft stopping position is calculated according to, for example, a method described below. When the estimated value of the crankshaft stopping position is calculated using the engine model 60, if the clutch is engaged, both the engine friction model 64 and the transmission friction model 65 are used as friction models. On the other hand, if the clutch is disengaged, only the engine friction model 64 is used as the friction model.

The average value of the combustion pressure P, the intake pressure $P_{map}$, the crank angle $\theta_0$, and the engine speed (combustion stop speed) $Ne_0$(=crank angle rotational speed $d\theta_0/dt$), which are obtained while the internal combustion engine is idling, are used as initial values. Then, estimated values of the crank angle θ and the crank angle rotational speed dθ/dt are calculated sequentially using the motion equation-based calculation unit 62. The calculation method will be described in detail with reference to Equations 13 and 14 below. In this specification, solving the engine model 60 along the direction of the arrows in FIG. 2 according to the calculation method described below will be referred to as the "forward model calculation".

First, in the equation of motion around the crankshaft expressed Equation 4e above, $(\partial f(\theta)/\partial\theta) \equiv h(\theta)$, and Equation 5 is substituted for the input torque TRQ in Equation 4e. Then, Equation 4e is discretized. As a result, Equation 13 below is derived.

[Equation 13]

$$\{\theta(k+2)-\theta(k+1)\}-\{\theta(k+1)-\theta(k)\} = \frac{\left[\begin{array}{c} TRQ_e(\theta(k)) - TRQ_f(\theta(k+1)-\theta(k)) - \\ \frac{1}{2}h(\theta(k))\cdot(\theta(k+1)-\theta(k))^2 \end{array}\right]}{f(\theta(k))} \quad 13$$

Then, as described above, the crank angle $\theta_0$ and the crank angle rotational speed dθ/dt, etc. are used as initial calculation values for the forward modal calculation according to Equation 13. Then, the estimated values of the corresponding crank angle θ and the crank angle rotational speed dθ/dt are calculated sequentially by sequentially updating the step number k. When 1 is substituted for the step number k in Equation 13, Equation 14a below is derived.

[Equation 14]

when $k = 1$. 14a $$\{\theta(2)-\theta(1)\}-\{\theta(1)-\theta(0)\} = \frac{\left[\begin{array}{c} TRQ_e(\theta(0)) - TRQ_{fr}(\theta(1)-\theta(0)) - \\ \frac{1}{2}h(\theta(0))\cdot(\theta(1)-\theta(0))^2 \end{array}\right]}{f(\theta(0))}$$

because $\dot{\theta}(1) = \{\theta(2)-\theta(1)\}$, $\dot{\theta}(0) = \{\theta(1)-(\theta)\}$ $$\dot{\theta}(1)-\dot{\theta}(0) = \frac{\left[TRQ_e(\theta(0)) - TRQ_{fr}(\dot{\theta}(0)) - \frac{1}{2}h(\theta(0))\cdot(\dot{\theta}(0))^2\right]}{f(\theta(0))} \quad 14b$$

$$\Leftrightarrow \dot{\theta}(1) = \frac{\left[TRQ_e(\theta(0)) - TRQ_{fr}(\dot{\theta}(0)) - \frac{1}{2}h(\theta(0))\cdot(\dot{\theta}(0))^2\right]}{f(\theta(0))+\dot{\theta}(0)} \quad 14c$$

$$\Leftrightarrow \dot{\theta}(1) = \frac{\left[TRQ_e(\theta(0)) - TRQ_{fr}(\dot{\theta}(0)) - \frac{1}{2}h(\theta(0))\cdot(\dot{\theta}(0))^2\right]}{f(\theta(0))+\dot{\theta}_1}$$

$$\theta(1) = \theta(0)+\dot{\theta}(0) = \theta(0)+\dot{\theta}_0 \quad 14d$$

When part of the crank angles θ(k) in Equation 14a are substituted for the corresponding crank angle rotational speeds dθ(k)/dt, Equation 14b is derived. When Equation 14b is expanded, the crank angle rotational speed dθ(1)/dt when the step number k is 1 is expressed using the immediately preceding crank angle and the crank angle rotational speed, that is, the crank angle $\theta_0$ and crank angle rotational speed $d\theta_0/dt$ that are used as the initial values, as shown in Equation 14c. Further, when Equation 14c is integrated, Equation 14d is derived. The crank angle θ(1) when the step number k is 1 is calculated by Equation 14d.

When the foregoing process is repeated until the step number k reaches a predetermined number N, i.e., until the crank angle rotational speed dθ(1)/dt becomes 0, the time required until the crank angle rotational speed dθ(N)/dt becomes 0 and the crank angle θ(N) are calculated. That is, according to the foregoing process, the estimated values of the engine speed Ne=0, and the crankshaft stopping position are calculated.

[Learning of Friction]

The main factor of the deviation of the crankshaft stopping position from the target stopping position, which occurs when the automatic transmission 10 is automatically stopped, may be the influence of the friction applied to the crankshaft 16. Therefore, the engine model 60 according to the first embodiment of the invention has a configuration for appropriately learning the friction. More specifically, the friction is learned according to the following method.

Figure 7:
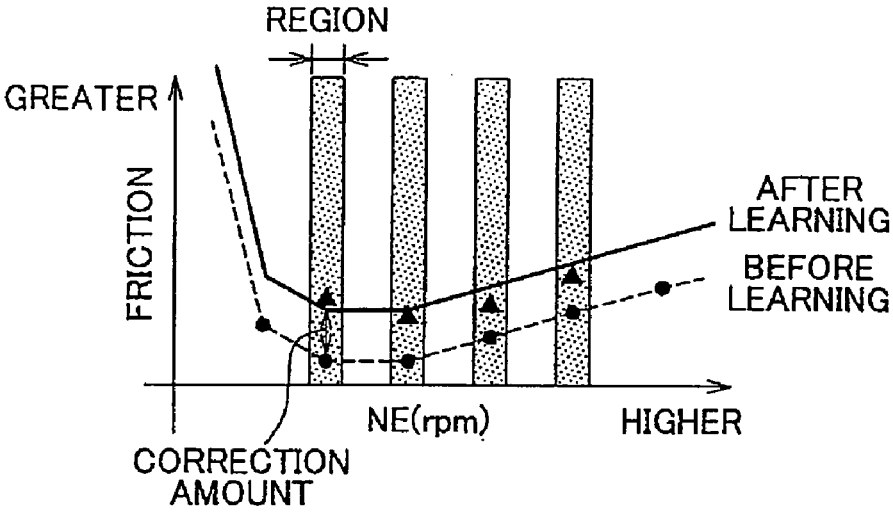
FIG. 7 is a graph illustrating a method for friction learning.

FIG. 7 is a graph illustrating a method for learning the friction. First, the deviation of the model value of the engine speed calculated using the model from the actually measured value of the engine speed Ne (hereinafter, this deviation will be referred to simply as the "speed deviation") is calculated. The PID controller 76 then reflects the PD correction amount, which is calculated by multiplying the speed deviation by a predetermined feedback gain, on a map value indicated in the friction map (see FIG. 4) in, for example, the engine friction model 64.

FIG. 7 illustrates the manner in which the friction map is corrected. The circles in the graph correspond to the map values at predetermined engine speeds, which are obtained before learning of the friction. The triangles in the graph correspond to the map values at the predetermined engine speeds, which are obtained after learning of the friction. In FIG. 7, the curve indicated by the broken line passes through the map values obtained before learning of the friction, while the curve indicated by the solid line passes through the map values obtained after learning of the friction.

As shown in FIG. 7, a predetermined range of the engine speed Ne is set for each map point. The PID correction amount is an average value or a temporal integration value of the correction amounts calculated within the range. The PID correction amount is calculated in this manner in order to minimize the influence of irrelevant fluctuations in the friction behavior. The PID correction amount thus calculated is reflected on each map value (i.e., each value indicated by a circle), whereby the value of the friction is updated to a new map value (i.e., each value indicated by a triangle). In this way, learning of the friction is executed.

Also, the engine model 60 has the separately-prepared engine friction model 64 and transmission friction model 65, as described above, in order to accurately execute the adaptive learning control for the crankshaft stopping position with the friction and inertia that vary depending on whether the clutch is engaged taken into account. Then, if the clutch is engaged when the vehicle is stopped, friction learning is executed using both the engine friction model 64 and the transmission friction model 65. On the other hand, if the clutch is disengaged when the vehicle is stopped, friction learning is executed using only the engine friction model 64.

[Calculation of the Combustion Stop Speed]

A method is known for controlling the engine speed at which ignition and fuel supply are stopped (i.e., the combustion stop speed) to bring the actual crankshaft stopping position to the target crankshaft stopping position when the internal combustion engine is automatically stopped. In the specification hereinafter, the combustion stop speed will also be referred to as the "ignition stop speed") where appropriate.

Figure 8:
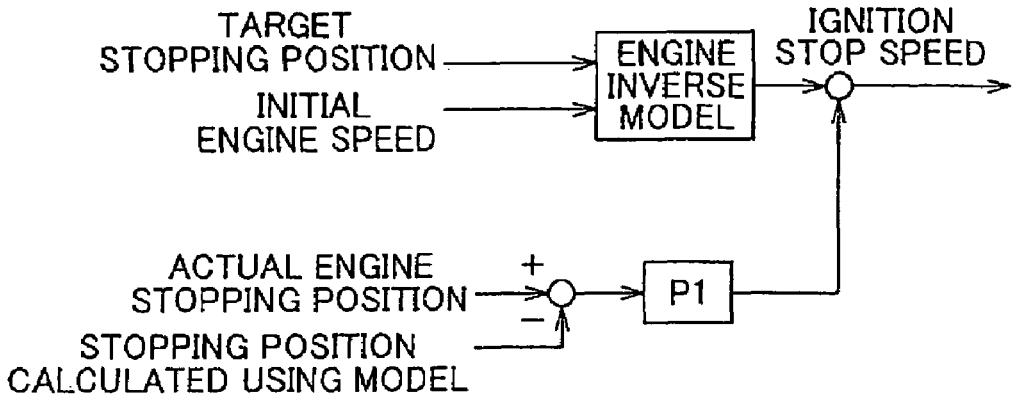
FIG. 8 is a block diagram showing a method for calculating a combustion stop speed.

FIG. 8 is a block diagram illustrating the method for calculating the combustion stop speed used in the system according to the first embodiment of the invention. According to the first embodiment of the invention, the ignition stop speed is calculated by executing an inverse model calculation using the engine model 60, as shown in FIG. 8. The inverse model calculation is a calculation method in which the engine model 60 is solved in the direction opposite to the direction in which the forward model calculation described above is executed. The target crankshaft stopping position (crank angle) at which the crankshaft 16 should stop and the initial engine speed (=0 rpm) are input in the engine model 60 as initial values, and an inverse model calculation is executed on the engine model 60. Thus, it is possible to calculate the target ignition stop speed at which the actual crankshaft stopping position matches the desired target crankshaft stopping position (the target ignition stop speed corresponds to the initial crank angle speed $d\theta_0/dt$ in the forward model calculation). According to this method, it is possible to obtain the ignition stop speed which reflects the influence of the friction that is appropriately learned.

According to the first embodiment of the invention, the ignition stop speed that is calculated by the inverse model calculation is corrected based on the deviation of the estimated value of the crankshaft stopping position calculated using the engine model 60 from the actual crankshaft stopping position. More specifically, a new target ignition stop speed is obtained by reflecting the correction amount, which is calculated by the PI control based on the above-described deviation, on the ignition stop speed obtained by the inverse model calculation, as shown in FIG. 8.

Figure 9:
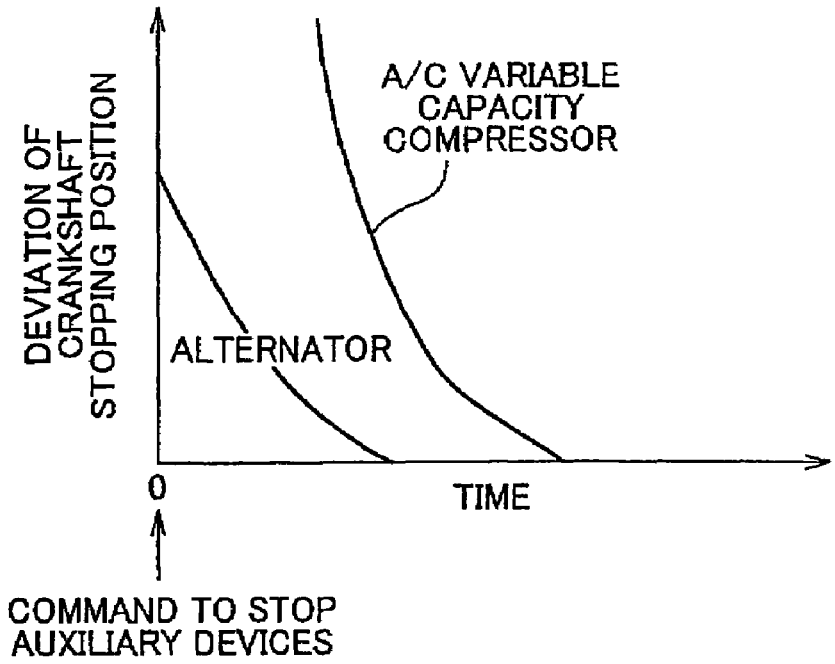
FIG. 9 is a graph showing an example of the relationship between the required time from when a command to stop the auxiliary devices is issued until when the loads placed on the internal combustion engine by the auxiliary devices are completely removed, and the deviation of the estimated value of the crankshaft stopping position from the actual crankshaft stopping position.

FIG. 9 is a graph showing an example of the relationship between the required time from when a command to stop the auxiliary devices 59 is issued until when the loads placed on the internal combustion engine 10 by the auxiliary devices 59 are completely removed, and the deviation of the estimated value of the crankshaft stopping position from the actual crankshaft stopping position. Concerning the deviation of the estimated crankshaft stopping position from the actual crankshaft stopping position, the state, in which the friction in the internal combustion engine 10, etc. are uniform and the loads placed on the internal combustion engine 10 by the auxiliary devices 59 are completely removed, is used as the reference state.

As shown in FIG. 9, a certain length of time is required from when the auxiliary devices 59 are stopped in response to a command from the ECU 50 until when the loads placed on the internal combustion engine 10 by the auxiliary devices 59 are completely removed. Also, the deviation of the estimated value of the crankshaft stopping position from the actual crankshaft stopping position varies depending on the amount of loads still placed on the internal combustion engine 10 by the auxiliary devices 59 after the auxiliary devices 59 are stopped hereinafter, such loads may also be referred to as the "residual loads"). Accordingly, if the auxiliary devices are stopped after a command to automatically stop the internal combustion engine is issued, the internal combustion engine may be automatically stopped before the loads placed on the internal combustion engine by the auxiliary devices are completely removed. In such a case, the crankshaft stopping position may vary depending on the amount of the loads still placed on the internal combustion engine when it is automatically stopped. If the internal combustion engine is kept at idle over an extended time period after a command to automatically stop the internal combustion engine is issued, the loads placed on the internal combustion engine by the auxiliary devices may be sufficiently removed while the internal combustion engine is idling. In this case, however, the internal combustion engine needlessly continues to operate for that extended time period, which reduces the fuel efficiency.

Therefore, according to the first embodiment of the invention, issuance of a command to automatically stop the internal combustion engine 10 (hereinafter, also referred to as an "automatic stop command") is predicted, and the auxiliary devices 59 are stopped immediately before the internal combustion engine 10 is automatically stopped actually. More specifically, when it is predicted that a command to automatically stop the internal combustion engine 10 will be issued, the auxiliary devices 59 are stopped before that automatic stop command is actually issued.

Figure 10:
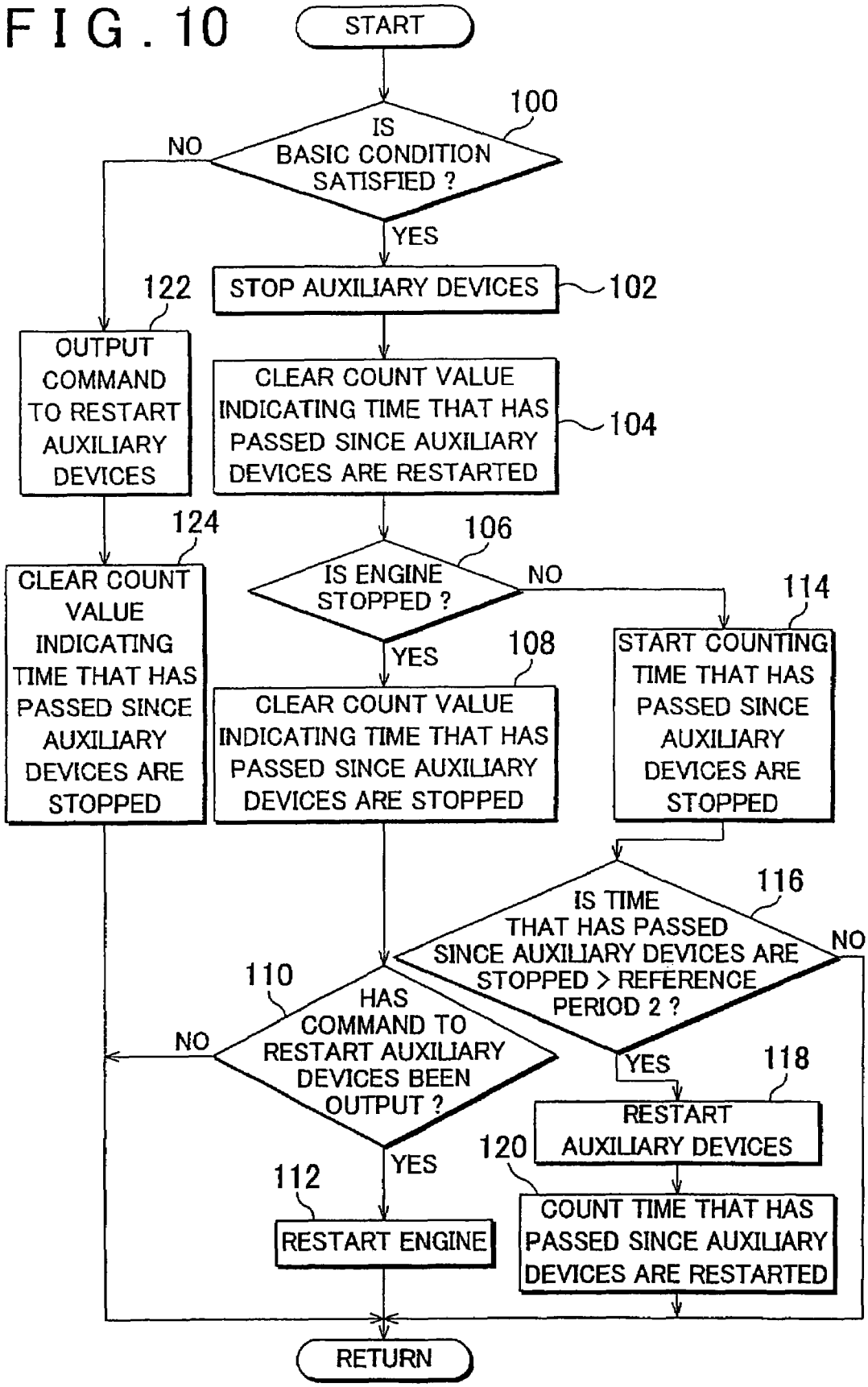
FIG. 10 is a flowchart of a routine according to a first embodiment of the invention.

FIG. 10 is a flowchart showing the routine that is executed by the ECU 50 according to the first embodiment of the invention. The function described above is implemented by executing the routine. In the routine shown in FIG. 10, first, it is determined whether a basic condition has been satisfied (step 100). The basic condition includes several conditions for determining whether a command to automatically stop the internal combustion engine 10 will be issued soon. More specifically, the basic condition includes the following four conditions 1 to 4. In step 100, it is determined whether all of these four conditions are satisfied at the same time.

The condition 1 is satisfied when it is determined that the vehicle speed is lower than a predetermined vehicle speed that is obtained by adding a predetermined speed $\alpha$ (e.g., 5 km/h) to the vehicle speed at which the internal combustion engine is automatically stopped (i.e., 0 km/h). The automatic stop condition is satisfied only when the vehicle is completely stopped. The condition 1 is therefore prepared in order to stop the auxiliary devices 59 before the automatic stop condition is satisfied. Also, the predetermined speed $\alpha$ is set in advance to a value at which the auxiliary devices 59 are stopped at an appropriate timing, when issuance of an automatic stop command is predicted. If the auxiliary devices 59 are stopped at this timing, the loads placed on the internal combustion engine 10 by the auxiliary devices 59 are completely removed before the automatic stop command is actually issued.

The condition 2 is satisfied when it is determined that the accelerator pedal is not depressed. The condition 2 is prepared in order not to erroneously predict that an automatic engine command will be issued, when the accelerator pedal is depressed, i.e., when it is recognized that the driver intends to accelerate the vehicle again.

Condition 3 is satisfied when any one of the following three conditions has been satisfied. The three conditions are i) that the internal combustion engine 10 is idling, ii) that the clutch switch 56 outputs an ON signal (i.e., indicating that the clutch is disengaged), when the internal combustion engine is used in combination with a manual transmission as in the case of the internal combustion engine 10, and iii) that the Neutral range is selected when the vehicle is provided with an automatic transmission. The condition 3 is prepared in order to accurately predict the timing at which the auxiliary devices 59 should be stopped independently of the driving habits of the driver.

Condition 4 is satisfied when time that has elapsed since the auxiliary devices are restarted (step 120) is longer than a predetermined reference period 1. The condition 4 is prepared in order to prevent the auxiliary devices 59 from being turning on and off excessively frequently.

When it is determined in step 100 that the basic condition described above has been satisfied, it is determined that an automatic stop command will be issued soon. Therefore, the auxiliary devices 59 are stopped (step 102). Then, the count value that indicates the time that has elapsed since the auxiliary devices 59 are restarted, which will be described later, is cleared (step 104).

Next, it is determined whether the internal combustion engine 10 has been automatically stopped (step 106). The internal combustion engine 10 is automatically stopped when the idle speed is adjusted to the current ignition stop speed in the case where the predetermined automatic stop condition for the eco-run control has been satisfied (i.e., when issuance of an automatic stop command has been detected). When it is determined in step 106 that the internal combustion engine 10 has been automatically stopped, the count value indicating the time that has elapsed since the auxiliary devices are stopped, which will be described later, is cleared (step 108).

Next, it is determined whether a command to restart to the auxiliary devices 59 (such as a command to start the alternator when the SOC (state-of-charge) of the battery is decreased, or a command to turn on the air-conditioner) has been issued (step 110). When it is determined that such a command to restart the auxiliary devices 59 has been issued, the internal combustion engine 10 is restarted in order to restart the auxiliary devices 59 (step 112).

On the other hand, when it is determined in step 106 that the internal combustion engine 10 has not been automatically stopped, i.e., when it is determined that the internal combustion engine 10 will be automatically stopped soon because the basic condition described above has been satisfied, but the predetermined automatic stop condition (e.g., that the vehicle speed is 0 km/h) is then not satisfied (i.e., an automatic stop command is ultimately not detected), the time that has elapsed since the auxiliary devices are stopped starts to be counted (step 114). If the process proceeds on to step 114 again before that count value indicating the time that has elapsed since the auxiliary devices are stopped (hereinafter, referred to as the "auxiliary device stop time") is cleared, counting is continued without clearing the count value.

Next, it is determined whether the auxiliary device stop time is longer than a predetermined reference period 2 (step 116). When the vehicle speed at which the internal combustion engine 10 is automatically stopped and the predetermined speed a, which are used to make a determination whether the condition 1 included in the basic condition has been satisfied, are 0 km/h and 5 km/h, respectively, if the vehicle runs continuously at 3 km/h (for example, when the vehicle is running on a downhill slope), the auxiliary devices 59 remain stopped according to steps 100 and 102. Therefore, in order to avoid such a situation, the reference period 2 used in step 116 is set. The reference period 2 is set to the maximum time period for which the auxiliary devices 59 are allowed to be continuously stopped (hereinafter, simply referred to as the "maximum allowed stop time"). The reference period 2 is set with the performance of each auxiliary device 59 taken into account.

When it is determined in step 116 that the auxiliary device stop time is longer than the reference period 2, the auxiliary devices 59 are restarted even if the basic condition described above has been satisfied (step 118). That is, in such a case, higher priority is given to reliably restarting the auxiliary devices 59 than to accurately controlling the crankshaft stopping position. In other words, the process for stopping the auxiliary devices 59 before the internal combustion engine 10 is automatically stopped is executed only in the case where each auxiliary device 59 is able to exhibit its performance when required. As a result, it is possible to more accurately execute the crankshaft stopping position control, while allowing the auxiliary devices 59 to exhibit their performance, for example, the air-conditioning performance, when required.

Next, the time that has elapsed since the auxiliary devices are restarted is counted (step 120). Counting is continued until the count value is cleared in step 104 described above.

On the other hand, when it is determined in step 100 that the basic condition has not been satisfied, a command to restart the auxiliary devices 59 is issued (step 122). With the process described above, the auxiliary devices 59 are restarted, when a determination that the auxiliary devices 59 are allowed to be restarted is made with whether another command to stop the auxiliary devices 59 has been issued taken into account. As a result, it is possible to avoid the situation in which the basic condition is once satisfied and the auxiliary devices 59 are stopped but then the basic condition becomes unsatisfied, for example, because the vehicle starts to accelerate, and therefore, the auxiliary devices 59 remains stopped. Next, the count value indicating the auxiliary device stop time is cleared (step 124).

According to the routine shown in FIG. 10 described above, when it is predicted that the internal combustion engine 10 will soon be automatically stopped, the auxiliary devices 59 are stopped before an automatic stop command is issued, more specifically, at a timing that is set such that the loads placed on the internal combustion engine 10 by the auxiliary devices 59 are completely removed before the automatic stop command is issued. Therefore, no load is placed on the internal combustion engine 10 by the auxiliary devices 59 when the internal combustion engine 10 is automatically stopped actually. As a result, it is possible to reliably prevent variation in the crankshaft stopping position, which occurs under the influence of the loads placed on the internal combustion engine by the auxiliary devices 59.

The system according to the first embodiment of the invention is configured to learn the influence of the friction on the crankshaft stopping position based on the deviation of the crankshaft stopping position estimated using the model from the actually measured crankshaft stopping position. In such a system, it is possible to reliably avoid the situation where the accuracy of friction learning is reduced under the influence of the loads placed on the internal combustion engine 10 by the auxiliary devices 59.

Also, according to the routine described above, in the case where, although the auxiliary devices 59 are stopped because it is predicated that the internal combustion engine 10 will be stopped soon, an automatic stop command is not issued within the predetermined time period after the auxiliary devices 59 are stopped (i.e., within the reference period 2), the auxiliary devices 59 are restarted. That is, in this case, higher priority is given to preventing the auxiliary devices 59 from being stopped for an excessively long time than to accurately controlling the crankshaft stopping position. Therefore, it is possible to avoid the situation where the auxiliary devices are not able to exhibit their performance when required because priority is given to accurately controlling the crankshaft stopping position.

The ECU 50 functions as a stop command determination unit according to the invention by determining whether a predetermined automatic stop condition for eco-run control has been satisfied. The ECU 50 also functions as an automatic stop execution unit according to the invention by stopping the ignition when the idle speed is controlled to the current ignition stop speed in the case where the automatic stop condition has been satisfied. The ECU 50 also functions as a stop command prediction unit according to the invention by executing step 100. Further, the ECU 50 functions as an auxiliary device stop unit according to the invention by executing step 102. The ECU 50 also functions as an auxiliary device stop unit according to the invention by executing steps 100 and 102. In addition, the engine friction model 64 and the transmission friction model 65 correspond to a friction model according to the invention. Also, the ECU 50 functions as a friction leaning unit according to the invention by executing friction learning according to the method indicated in FIG. 7. The ECU 50 also functions as a crankshaft position estimation unit according to the invention by calculating an estimated value of the crankshaft stopping position according to the forward model calculation of the engine model 60. Further, the ECU 50 functions as an auxiliary device restarting unit according to the invention by executing steps 106 and 114 to 118.

Second Embodiment of the Invention

Next, a second embodiment of the invention will be described with reference to FIG. 11. The system according to the second embodiment of the invention has the hardware configuration shown in FIG. 1 and the engine model 60 having the configuration shown in FIG. 2. The system according to the second embodiment of the invention differs from the system according to the first embodiment of the invention in that the ECU 50 executes the routine shown in FIG. 11 instead of the routine shown in FIG. 10.

The system according to the second embodiment of the invention executes the control according to the first embodiment of the invention described above. In addition to the control described above, the ECU 50 executes an additional step in which the auxiliary devices 59 are prohibited from being stopped before the internal combustion engine 10 is automatically stopped, when a hazard switch 58 is turned on and the hazard lights are flashing. A driver usually turns on the hazard switch 58, for example, in the event of an emergency or when the driver is parking the vehicle, for example, the driver is performing parallel parking or moving the vehicle into a parking space or garage, in order to indicate such situation to others in the vicinity.

Therefore, according to the second embodiment of the invention, the eco-run control is prohibited, i.e., the automatic stop of the internal combustion engine 10 is prohibited, when the hazard lights are flashing. This makes it possible to satisfy a demand to quickly restart the vehicle or a demand to quickly accelerate the vehicle again in the event of an emergency. This also avoid the situation where the internal combustion engine 10 is automatically stopped and restarted frequently as the vehicle repeatedly starts and stops moving when being parked. The auxiliary devices 59 are also prohibited from being stopped before an automatic stop command is issued.

Figure 11A:
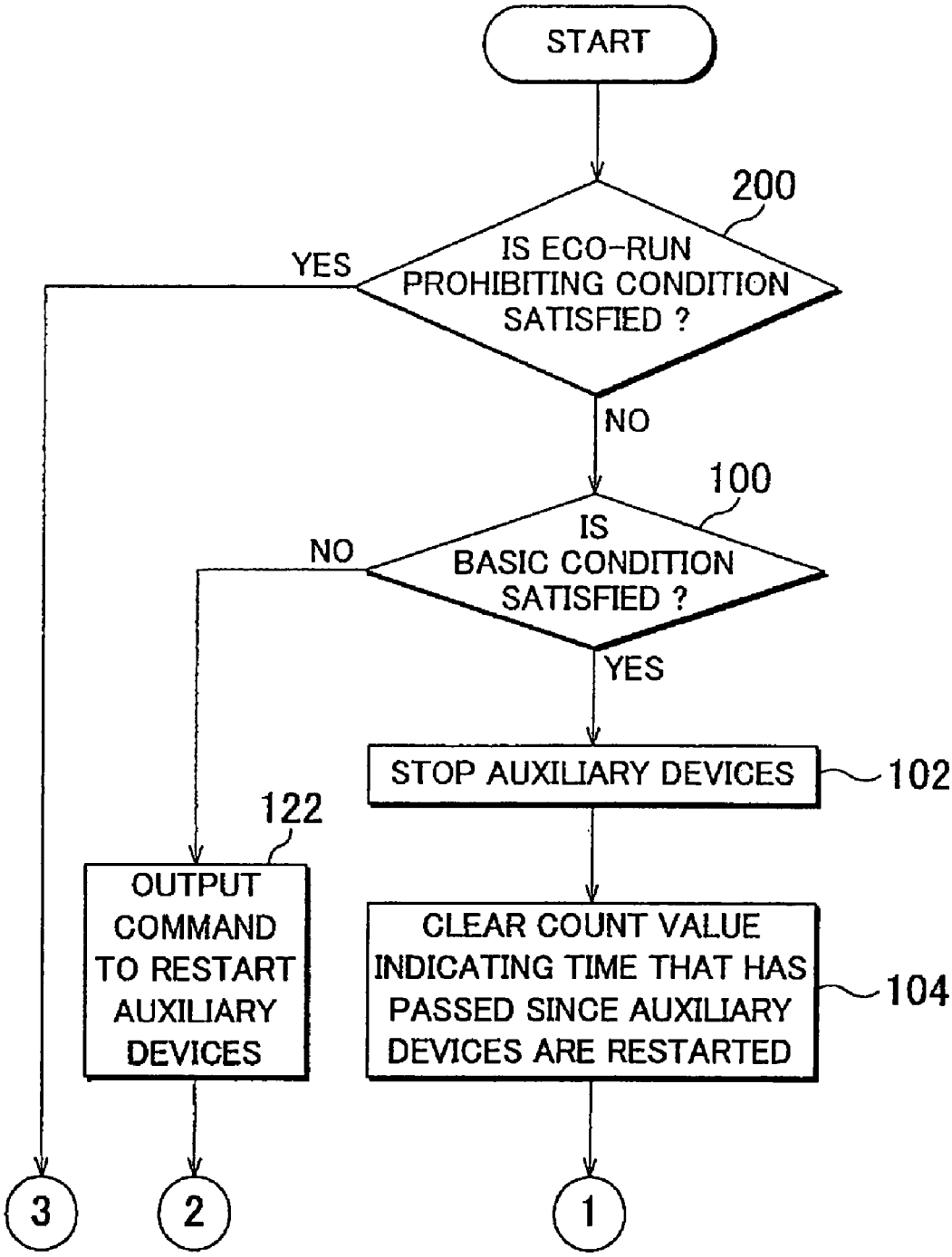
FIG. 11 is a flowchart of a routine according to a second embodiment of the invention.
Figure 11B:
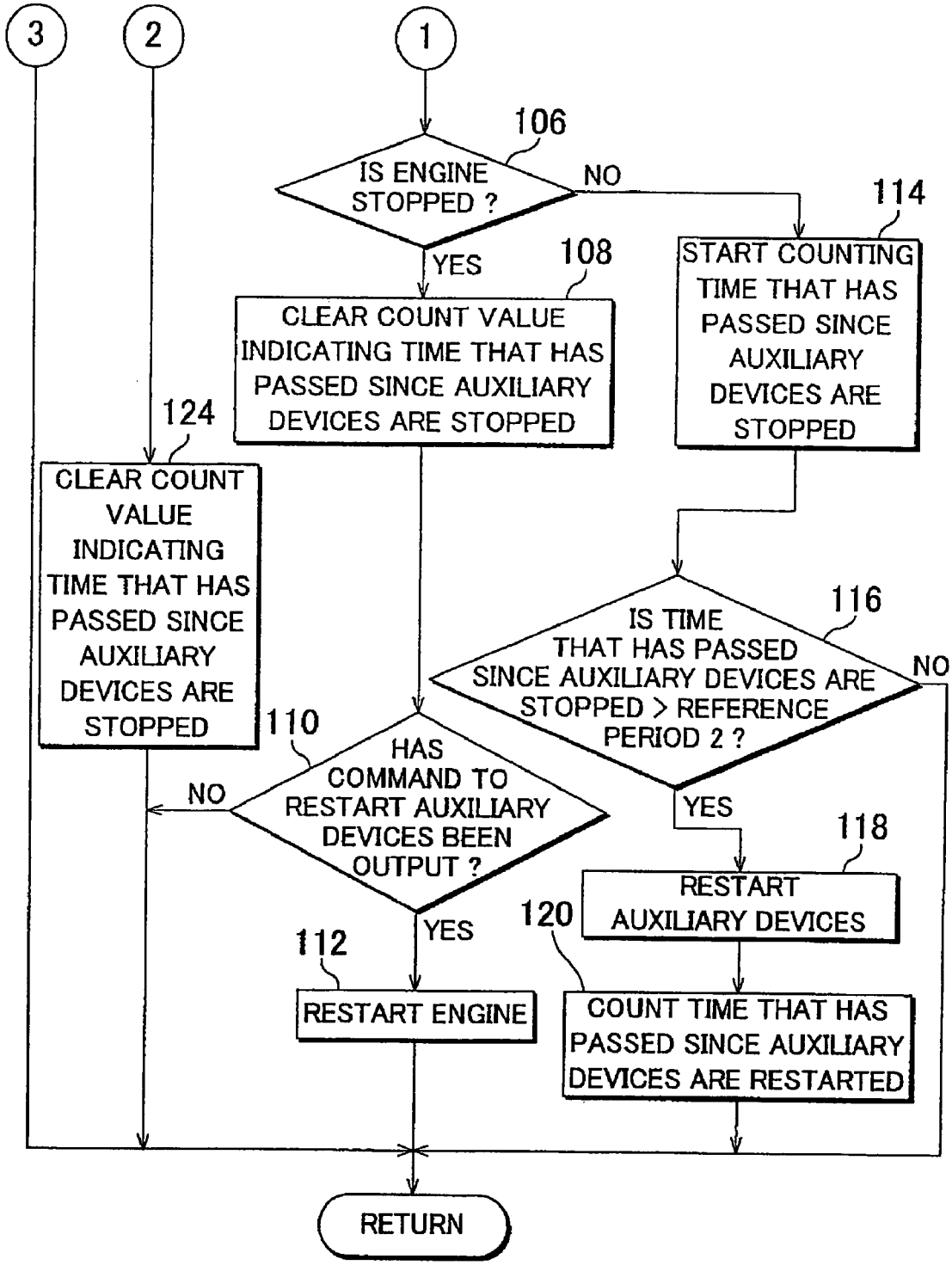

FIG. 11 is a flowchart of the routine that is executed by the ECU 50 according to the second embodiment of the invention. The function described above is implemented by executing the routine in FIG. 11. The routine shown in FIG. 11 is the same as the routine shown in FIG. 10 according to the first embodiment of the invention except that step 200 is added.

In the routine shown in FIG. 12, first, it is determined whether an eco-run control prohibition condition has been satisfied (step 200). This eco-run control prohibition condition includes predetermined conditions and a condition concerning the ON/OFF state of the hazard switch 58. When it is determined that the hazard switch 58 is on, the ECU 50 prohibits the eco-run control.

When it is determined in step 200 that the eco-run control prohibition condition has been satisfied, the current routine immediately ends. On the other hand, when it is determined that the eco-run control prohibition condition has not been satisfied, steps 100 and the following steps, described above, are executed.

According to the routine shown in FIG. 11 described above, automatic stop of the internal combustion engine according to eco-run control is prohibited when the hazard switch 58 is on and the hazard lights are flashing. Therefore, in a vehicular system, for example, the system according to the second embodiment of the invention, which is provided with only the internal combustion engine 10 as a drive power source, it is possible to satisfy a demand to quickly accelerate the vehicle again or a demand to smoothly move the vehicle operation during parking. Also, when the hazard lights are flashing, a determination as to whether the basic condition has been satisfied is not made, i.e., a determination as to whether a command to automatically stop the internal combustion engine 10 will be issued will not be made. Accordingly, the auxiliary devices 59 are prevented from being stopped unnecessarily, when it is recognized that automatically stopping the internal combustion engine 10 is inappropriate because the hazard lights are flashing, for example, in the event of an emergency.

The ECU 50 functions as an automatic stop prohibition unit according to the invention by determining in step 200 that the eco-run control prohibition condition has been satisfied when the hazard switch 58 is on. Also, the ECU 50 functions as an auxiliary device stop prohibition unit according to the invention by not executing step 102 when it is determined in step 200 that the eco-run prohibition condition has been satisfied.

While the invention has been described with reference to embodiments thereof, it is to be understood that the invention is not limited to the embodiments or constructions. To the contrary, the invention is intended to cover various modifications and equivalent arrangements. In addition, while the various elements of the embodiments are shown in various combinations and configurations, which are exemplary, other combinations and configurations, including more, less or only a single element, are also within the spirit and scope of the invention.

What is claimed is:

1. A stopping position control apparatus for an internal combustion engine, comprising:

stop command determination means for determining whether a command to automatically stop the internal combustion engine has been issued;

automatic stop execution means for stopping combustion in the internal combustion engine, when an engine speed matches a combustion stop speed after it is determined that the command to automatically stop the internal combustion engine has been issued;

stop command prediction means for predicting whether the command to automatically stop the internal combustion engine is issued; and auxiliary device stopping means for stopping an auxiliary device of the internal combustion engine before the command to automatically stop the internal combustion engine is issued, when issuance of the command to automatically stop the internal combustion engine is predicted.

2. A stopping position control apparatus for an internal combustion engine, comprising:

stop command determination means for determining whether a command to automatically stop the internal combustion engine has been issued;

automatic stop execution means for stopping combustion in the internal combustion engine, when an engine speed matches a combustion stop speed after it is determined that the command to automatically stop the internal combustion engine has been issued;

a friction model used to calculate friction applied to a crankshaft of the internal combustion engine;

friction learning means for learning the friction model based on information concerning a crank angle in the internal combustion engine;

crankshaft position estimation means for obtaining an estimated value of a crankshaft stopping position based on predetermined parameters including the friction and atmospheric pressure;

stop command prediction means for predicting whether the command to automatically stop the internal combustion engine is issued; and auxiliary device stop means for stopping an auxiliary device of the internal combustion engine before the command to automatically stop the internal combustion engine is issued, when issuance of the command to automatically stop the internal combustion engine is predicted.

3. A stopping position control apparatus for an internal combustion engine, comprising:

stop command determination means for determining whether a command to automatically stop the internal combustion engine has been issued;

automatic stop execution means for stopping combustion in the internal combustion engine, when an engine speed matches a combustion stop speed after it is determined that the command to automatically stop the internal combustion engine has been issued;

stop command prediction means for predicting whether the command to automatically stop the internal combustion engine is issued, and auxiliary device stopping means for stopping an auxiliary device of the internal combustion engine at a tinting that is set such that a load placed on the internal combustion engine by the auxiliary device is completely removed before the command to automatically stop the internal combustion engine is issued, when issuance of the command to automatically stop the internal combustion engine is predicted.

4. A stopping position control apparatus for an internal combustion engine, comprising:

stop command determination means for determining whether a command to automatically stop the internal combustion engine has been issued;

automatic stop execution means for stopping combustion in the internal combustion engine, when an engine speed matches a combustion stop speed after it is determined that the command to automatically stop the internal combustion engine has been issued;

a friction model used to calculate friction applied to a crankshaft of the internal combustion engine;

friction learning means for learning the friction model based on information concerning a crank angle in the internal combustion engine;

crankshaft position estimation means for obtaining an estimated value of a crankshaft stopping position based on predetermined parameters including the friction and atmospheric pressure;

stop command prediction means for predicting whether the command to automatically stop the internal combustion engine is issued; and auxiliary device stop means for stopping an auxiliary device of the internal combustion engine at a timing that is set such that a load placed on the internal combustion engine by the auxiliary device is completely removed before the command to automatically stop the internal combustion engine is issued, when issuance of the command to automatically stop the internal combustion engine is predicted.

5. A stopping position control apparatus for an internal combustion engine, comprising:

a stop command determination unit that determines whether a command to automatically stop the internal combustion engine has been issued;

an automatic stop execution unit that stops combustion in the internal combustion engine, when an engine speed matches a combustion stop speed after it is determined that the command to automatically stop the internal combustion engine has been issued;

a stop command prediction unit that predicts whether the command to automatically stop the internal combustion engine is issued; and an auxiliary device stop unit that stops an auxiliary device of the internal combustion engine before the command to automatically stop the internal combustion engine is issued, when issuance of the command to automatically stop the internal combustion engine is predicted.

6. The stopping position control apparatus according to claim 5, further comprising:

an auxiliary device restarting unit that restart the auxiliary device when the command to automatically stop the internal combustion engine is not issued within a predetermined time period after the auxiliary device is stopped based on the prediction.

7. The stopping position control apparatus according to claim 5, further comprising:

an automatic stop prohibition unit that prohibits the internal combustion engine from being automatically stopped, when a hazard light of a vehicle is on.

8. The stopping position control apparatus according to claim 5, further comprising:

an auxiliary device stop prohibition unit that prohibits the auxiliary device from being stopped based on the prediction, when a hazard light of a vehicle is on.

9. A stopping position control apparatus for an internal combustion engine, comprising:

a stop command determination unit that determines whether a command to automatically stop the internal combustion engine has been issued;

an automatic stop execution unit that stops combustion in the internal combustion engine, when an engine speed matches a combustion stop speed after it is determined that the command to automatically stop the internal combustion engine has been issued;

a friction model used to calculate friction applied to a crankshaft of the internal combustion engine;

a friction learning unit that learns the friction model based on information concerning a crank angle in the internal combustion engine;

a crankshaft position estimation unit that obtains an estimated value of a crankshaft stopping position based on predetermined parameters including the friction and atmospheric pressure;

a stop command prediction unit that predicts whether the command to automatically stop the internal combustion engine is issued; and an auxiliary device stop unit that stops an auxiliary device of the internal combustion engine before the command to automatically stop the internal combustion engine is issued, when issuance of the command to automatically stop the internal combustion engine is predicted.

10. The stopping position control apparatus according to claim 9, further comprising:

an auxiliary device restarting unit that restart the auxiliary device when the command to automatically stop the internal combustion engine is not issued within a predetermined time period after the auxiliary device is stopped based on the prediction.

11. The stopping position control apparatus according to claim 9, further comprising:

an automatic stop prohibition unit that prohibits the internal combustion engine from being automatically stopped, when a hazard light of a vehicle is on.

12. The stopping position control apparatus according to claim 9, further comprising:

an auxiliary device stop prohibition unit that prohibits the auxiliary device from being stopped based on the prediction, when a hazard light of a vehicle is on.

13. A stopping position control apparatus for an internal combustion engine, comprising:

a stop command determination unit that determines whether a command to automatically stop the internal combustion engine has been issued;

an automatic stop execution unit that stops combustion in the internal combustion engine, when an engine speed matches a combustion stop speed after it is determined that the command to automatically stop the internal combustion engine has been issued;

a stop command prediction unit that predicts whether the command to automatically stop the internal combustion engine is issued; and an auxiliary device stop unit that stops an auxiliary device of the internal combustion engine at a timing that is set such that a load placed on the internal combustion engine by the auxiliary device is completely removed before the command to automatically stop the internal combustion engine is issued, when issuance of the command to automatically stop the internal combustion engine is predicted.

14. The stopping position control apparatus according to claim 13, further comprising:

an auxiliary device restarting unit that restart the auxiliary device when the command to automatically stop the internal combustion engine is not issued within a predetermined time period after the auxiliary device is stopped based on the prediction.

15. The stopping position control apparatus according to claim 13, further comprising:

an auxiliary device stop prohibition unit that prohibits the auxiliary device from being stopped based on the prediction, when a hazard light of a vehicle is on.

16. The stopping position control apparatus according to claim 13, further comprising:

an auxiliary device stop prohibition unit that prohibits the auxiliary device from being stopped based on the prediction, when a hazard light of a vehicle is on.

17. A stopping position control apparatus for an internal combustion engine, comprising:

a stop command determination unit that determines whether a command to automatically stop the internal combustion engine has been issued;

an automatic stop execution unit that stops combustion in the internal combustion engine, when an engine speed matches a combustion stop speed after it is determined that the command to automatically stop the internal combustion engine has been issued;

a friction model used to calculate friction applied to a crankshaft of the internal combustion engine;

a friction learning unit that learns the friction model based on information concerning a crank angle in the internal combustion engine;

a crankshaft position estimation unit that obtains an estimated value of a crankshaft stopping position based on predetermined parameters including the friction and atmospheric pressure;

a stop command prediction unit that predicts whether the command to automatically stop the internal combustion engine is issued; and an auxiliary device stop unit that stops an auxiliary device of the internal combustion engine at a timing that is set such that a load placed on the internal combustion engine by the auxiliary device is completely removed before the command to automatically stop the internal combustion engine is issued, when issuance of the command to automatically stop the internal combustion engine is predicted.

18. The stopping position control apparatus according to claim 17, further comprising:

an auxiliary device restarting unit that restart the auxiliary device when the command to automatically stop the internal combustion engine is not issued within a predetermined time period after the auxiliary device is stopped based on the prediction.

19. The stopping position control apparatus according to claim 17, further comprising:

an auxiliary device stop prohibition unit that prohibits the auxiliary device from being stopped based on the prediction, when a hazard light of a vehicle is on.

20. The stopping position control apparatus according to claim 17, further comprising:

an auxiliary device stop prohibition unit that prohibits the auxiliary device from being stopped based on the prediction, when a hazard light of a vehicle is on.

21. A stopping position control method for an internal combustion engine, comprising:

determining whether a command to automatically stop the internal combustion engine has been issued;

stopping combustion in the internal combustion engine, when an engine speed matches a combustion stop speed after it is determined that the command to automatically stop the internal combustion engine has been issued;

predicting whether the command to automatically stop the internal combustion engine is issued; and stopping an auxiliary device of the internal combustion engine before the command to automatically stop the internal combustion engine is issued, when issuance of the command to automatically stop the internal combustion engine is predicted.

22. A stopping position control method for an internal combustion engine, comprising:

determining whether a command to automatically stop the internal combustion engine has been issued, stopping combustion in the internal combustion engine, when an engine speed matches a combustion stop speed after it is determined that the command to automatically stop the internal combustion engine has been issued;

learning a friction model used to calculate friction applied to a crankshaft of the internal combustion engine based on information concerning a crank angle in the internal combustion engine;

estimating a crankshaft stopping position based on predetermined parameters including the friction and atmospheric pressure;

predicting whether the command to automatically stop the internal combustion engine is issued; and stopping an auxiliary device of the internal combustion engine before the command to automatically stop the internal combustion engine is issued, when issuance of the command to automatically stop the internal combustion engine is predicted.

23. A stopping position control method for an internal combustion engine, comprising:

determining whether a command to automatically stop the internal combustion engine has been issued;

stopping combustion in the internal combustion engine, when an engine speed matches a combustion stop speed after it is determined that the command to automatically stop the internal combustion engine has been issued;

predicting whether the command to automatically stop the internal combustion engine is issued; and stopping an auxiliary device of the internal combustion engine such that a load placed on the internal combustion engine by the auxiliary device is removed before the command to automatically stop the internal combustion engine is issued, when issuance of the command to automatically stop the internal combustion engine is predicted.

24. A stopping position control method for an internal combustion engine, comprising:

determining whether a command to automatically stop the internal combustion engine has been issued;

stopping combustion in the internal combustion engine, when an engine speed matches a combustion stop speed after it is determined that the command to automatically stop the internal combustion engine has been issued;

learning a friction model used to calculate friction applied to a crankshaft of the internal combustion engine based on information concerning a crank angle in the internal combustion engine;

estimating a crankshaft stopping position based on predetermined parameters including the friction and atmospheric pressure;

predicting whether the command to automatically stop the internal combustion engine is issued; and stopping an auxiliary device of the internal combustion engine such that a load placed on the internal combustion engine by the auxiliary device is removed before the command to automatically stop the internal combustion engine is issued, when issuance of the command to automatically stop the internal combustion engine is predicted.

* * * * *